US011040557B2

(12) United States Patent
Igarashi

(10) Patent No.: US 11,040,557 B2
(45) Date of Patent: Jun. 22, 2021

(54) CUTTING HEAD-INCLUDING PRINTER

(71) Applicant: Roland DG Corporation, Hamamatsu (JP)

(72) Inventor: Masakazu Igarashi, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 63 days.

(21) Appl. No.: 16/695,951

(22) Filed: Nov. 26, 2019

(65) Prior Publication Data

US 2020/0171858 A1 Jun. 4, 2020

(30) Foreign Application Priority Data

Nov. 30, 2018 (JP) ..... JP2018-225396

(51) Int. Cl.

| | |
|---|---|
| ***B41J 13/02*** | (2006.01) |
| ***B65H 5/06*** | (2006.01) |
| ***B41J 11/66*** | (2006.01) |
| *B41J 15/04* | (2006.01) |

(52) U.S. Cl.

CPC ..... *B41J 13/025* (2013.01); *B41J 11/663* (2013.01); *B65H 5/062* (2013.01); *B41J 15/04* (2013.01)

(58) Field of Classification Search

CPC ..... B41J 13/025; B41J 11/663; B41J 15/04; B65H 5/062

See application file for complete search history.

(56) References Cited

U.S. PATENT DOCUMENTS

| | | | | |
|---|---|---|---|---|
| 9,969,192 | B2 * | 5/2018 | Suzuki | B65H 23/188 |
| 2004/0079248 | A1 * | 4/2004 | Mayer | B41J 3/60 101/229 |
| 2005/0187104 | A1 * | 8/2005 | Laney | G09F 3/10 503/227 |
| 2006/0245804 | A1 * | 11/2006 | Yamamoto | B42C 19/06 400/62 |
| 2007/0006963 | A1 * | 1/2007 | Bever | G09F 3/02 156/213 |
| 2007/0082560 | A1 * | 4/2007 | Acher | B42F 1/00 439/845 |

(Continued)

FOREIGN PATENT DOCUMENTS

| | | | | |
|---|---|---|---|---|
| JP | 4855510 B | | 1/2012 | |
| JP | 2013-159079 A | | 8/2013 | |
| JP | 2016-143240 | * | 7/2016 | B26D 5/26 |

*Primary Examiner* — David H Banh

(74) *Attorney, Agent, or Firm* — Knobbe, Martens, Olson & Bear, LLP

(57) ABSTRACT

A cutting head-including printer includes at least one driving roller, a pair of side pinch rollers, a center pinch roller provided between the pair of side pinch rollers, and a roller moving mechanism that causes the center pinch roller to approach, or to be separated from, the at least one driving roller. The cutting head-including printer sets whether to perform cutting after printing or to perform the printing after the cutting. During the cutting performed after the printing, the cutting head-including printer separates the center pinch roller from the at least one driving roller. During the cutting performed before the printing, the cutting head-including printer locates the center pinch roller at a position where the center pinch roller holds a recording medium together with the at least one driving roller.

3 Claims, 14 Drawing Sheets

(56) References Cited

U.S. PATENT DOCUMENTS

| | | | | |
|---|---|---|---|---|
| 2011/0293349 | A1* | 12/2011 | Tombs | H04N 1/387 400/583 |
| 2011/0316925 | A1* | 12/2011 | Saita | B41J 3/60 347/19 |
| 2012/0148326 | A1* | 6/2012 | Ipponyari | B26D 5/34 400/621 |
| 2012/0228089 | A1* | 9/2012 | Tanaka | B65H 5/062 198/604 |
| 2012/0312854 | A1* | 12/2012 | Takizawa | B41J 15/04 226/1 |
| 2013/0003097 | A1* | 1/2013 | Yokoyama | G06K 15/1822 358/1.13 |
| 2014/0293376 | A1* | 10/2014 | Tokura | H04N 1/00795 358/498 |
| 2015/0002866 | A1* | 1/2015 | Koike | G06F 3/1285 358/1.6 |
| 2015/0069650 | A1* | 3/2015 | Boudouris | D21H 27/20 264/132 |
| 2016/0114426 | A1* | 4/2016 | Herrmann | B23K 26/38 493/373 |
| 2018/0021969 | A1* | 1/2018 | Fujita | B26D 5/26 83/286 |
| 2018/0147866 | A1* | 5/2018 | Ramis Llinares | B41J 11/663 |
| 2019/0111712 | A1 | 4/2019 | Nonaka et al. | |
| 2020/0009885 | A1* | 1/2020 | Rubio | B41J 11/666 |
| 2020/0038917 | A1* | 2/2020 | McBride | B07C 5/361 |

* cited by examiner

CUTTING HEAD-INCLUDING PRINTER

CROSS-REFERENCE TO RELATED APPLICATION

This application claims the benefit of priority to Japanese Patent Application No. 2018-225396 filed on Nov. 30, 2018. The entire contents of this application are hereby incorporated herein by reference.

BACKGROUND OF THE INVENTION

Field of the Invention

The present invention relates to a printer including a cutting head (hereinafter, referred to as a "cutting head-including printer").

Description of the Related Art

Conventionally, a cutting head-including printer that prints an image on a recording medium and cuts the recording medium is known. Many cutting head-including printers each include driving rollers and pinch rollers moving the recording medium during printing and cutting. The driving rollers rotate to transport the recording medium, and are generally embedded in a platen. The pinch rollers are provided to face the driving rollers and hold the recording medium together with the driving rollers to press the recording medium. When it is attempted to cut the recording medium by such a cutting head-including printer after the printing, an inconvenience may occur that the pinch rollers contact the printed image and as a result, for example, damages the image. In such a situation, Japanese Patent No. 4855510 discloses a cutting head-including printer including side pinch rollers pressing both of two ends of the recording medium and a center pinch roller pressing a central portion of the recording medium. During the cutting, the side pinch rollers are caused to contact the recording medium while the center pinch roller is prevented from contacting the recording medium.

As described above, many cutting head-including printers perform the printing first and then perform the cutting. However, a cutting head-including printer capable of performing the cutting first is also known. For example, Japanese Laid-Open Patent Publication No. 2013-159079 discloses a cutting head-including printer performing the cutting before the printing. The cutting head-including printer described in Japanese Laid-Open Patent Publication No. 2013-159079 has one object of shortening the wait time in which the printer waits for ink to be dried. The cutting head-including printer described in Japanese Laid-Open Patent Publication No. 2013-159079 performs the printing after the cutting, and therefore, does not need to wait for the ink to be dried. As can be seen, there is a need for a cutting head-including printer that performs the cutting before the printing.

In the case where the cutting is performed before the printing by a cutting head-including printer as disclosed in Japanese Laid-Open Patent Publication No. 2013-159079, there is an undesirable possibility that if the center pinch roller is separated from the recording medium as disclosed in Japanese Patent No. 4855510, the movement of the recording medium becomes unstable during the cutting and thus the cutting quality is deteriorated.

SUMMARY OF THE INVENTION

Preferred embodiments of the present invention provide cutting head-including printers improving the cutting quality in the case where the cutting is performed before the printing.

A cutting head-including printer disclosed herein includes a supporting table including a carrying surface on which a recording medium is to be placed; a transportation mechanism that transports the recording medium placed on the carrying surface in a first transportation direction and a second transportation direction opposite to the first transportation direction; a printing head provided to face the carrying surface; a cutting head provided to face the carrying surface; and a controller. The transportation mechanism includes a pair of side pinch rollers, a center pinch roller, at least one driving roller, a driving mechanism, and a roller moving mechanism. The pair of side pinch rollers are provided to face both of two ends of the carrying surface in a direction perpendicular to the first transportation direction. The center pinch roller is provided between the pair of side pinch rollers and faces the carrying surface. The at least one driving roller is provided on the supporting table to face the side pinch rollers and the center pinch roller and has at least a portion thereof exposed to the carrying surface. The driving mechanism rotates the at least one driving roller in the first transportation direction and the second transportation direction. The roller moving mechanism causes the center pinch roller to approach or, to be separated from, the at least one driving roller. The side pinch rollers hold the recording medium placed on the carrying surface together with the at least one driving roller. The roller moving mechanism moves the center pinch roller to a first position at which the center pinch roller holds the recording medium placed on the carrying surface together with the at least one driving roller and to a second position at which the center pinch roller is separated from the at least one driving roller. The controller includes a data storage, a mode setter, and a roller position controller. The data storage stores working data including at least one of printing data and cutting data. The mode setter sets a working mode in which printing and cutting are executed to a first working mode or to a second working mode. The first working mode is a working mode in which the printing is first executed and then the cutting is executed. The second working mode is a working mode in which the cutting is first executed and then the printing is executed. The roller position controller controls the roller moving mechanism to, in the case where the working mode is set to the first working mode, locate the center pinch roller at the second position during the cutting and to, in the case where the working mode is set to the second working mode, locate the center pinch roller at the first position during the cutting.

According to the above-described cutting head-including printer, in the second working mode, in which the cutting is performed before the printing, during the cutting, the center pinch roller is located at the first position. At the first position, the center pinch roller is in contact with the recording medium, and presses the recording medium together with the side pinch rollers. This stabilizes the movement of the recording medium during the cutting. Therefore, the cutting head-including printer improves the cutting quality in the second working mode.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENT

Figure 1:
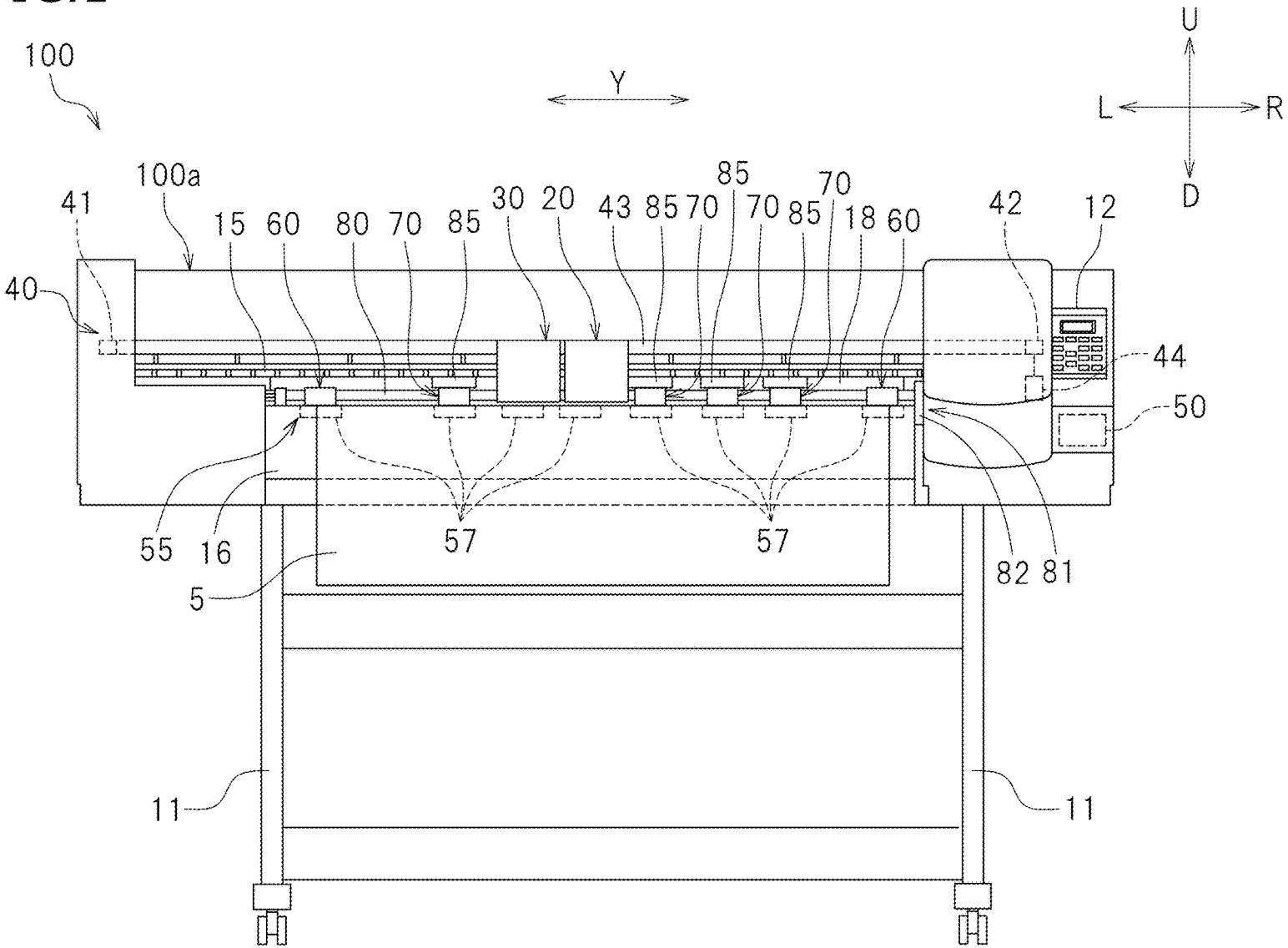
FIG. 1 is a front view of a cutting head-including printer according to a preferred embodiment of the present invention.

Hereinafter, preferred embodiments of a cutting head-including printer (hereinafter, referred to as a "printer 100") according to the present invention will be described with reference to the drawings. The preferred embodiments described herein are not intended to specifically limit the present invention, needless to say. Components and portions that have the same functions will bear the same reference signs, and overlapping descriptions will be omitted or simplified. As shown in FIG. 1, the printer 100 according to a preferred embodiment is a printer/cutter capable of performing printing on, and cutting, a recording medium 5.

In the following description, the terms "left", "right", "up" and "down" respectively refer to left, right, up and down as seen from an operator who faces a front surface of the printer 100. A direction separated away from the printer 100 toward the operator is referred to as "forward", and a direction approaching the printer 100 away from the operator is referred to as "rearward". In the drawings, letters F, Rr, L, R, U and D respectively represent front, rear, left, right, up and down. In the drawings, letter X represents a transportation direction in which the recording medium 5 is transported. In this preferred embodiment, the transportation direction X is a front-rear direction. In the drawings, letter Y represents a scanning direction. The scanning direction Y is a direction perpendicularly crossing the transportation direction X. In this preferred embodiment, the scanning direction Y is a left-right direction. The above-described directions are merely defined for the sake of convenience, and are not to be construed in a limited manner.

The recording medium 5 is, for example, a recording paper sheet. The recording medium 5 is not limited to a recording paper sheet. The recording medium 5 may be, for example, a sheet formed of a resin material such as PVC, polyester or the like, a sealing member including a mount paper board and a release paper sheet that is stacked on the mount paper board and is coated with a pressure-sensitive adhesive, a metal plate formed of aluminum, iron or the like, a glass plate, a wooden plate, or the like. In this specification, the terms "cut" and "cutting" refer to cutting the recording medium 5 in the entirety of the thickness direction thereof (e.g., cutting both of the mount paper board and the release paper sheet of the sealing member) and cutting the recording medium 5 in a portion of the thickness direction thereof (e.g., cutting only the releasing paper sheet without cutting the mount paper board).

As shown in FIG. 1, the printer 100 includes a main body 100*a*, legs 11, an operation panel 12, a platen 16 on which the recording medium 5 is to be placed, an inkjet head 20, a cutting head 30, a head moving mechanism 40, a transportation device 55, and a controller 50. The main body 100*a* includes a casing extending in the scanning direction Y. The legs 11 support the main body 100*a*, and are provided on a bottom surface of the main body 100*a*. The operation panel 12 is provided on, for example, a front surface of a right portion of the main body 100*a*. There is no specific limitation on the position of the operation panel 12. The operation panel 12, for example, allows the operator to make an operation regarding the printing or the cutting. Although not shown, the operation panel 12 includes a display that displays information on the printing, for example, the resolution, the darkness of the ink and the like, the status of the printer 100 during the printing or the cutting, and the like, and also includes an input portion into which information on the printing or the cutting is to be input.

The platen 16 is a supporting table that supports the recording medium 5 while the printing is being performed on the recording medium 5 and while the recording medium 5 is being cut. The platen 16 includes a carrying surface 16*a* (see FIG. 2A), on which the recording medium 5 is to be placed. In this preferred embodiment, the carrying surface 16*a* is a top surface of the platen 16. The printing on the recording medium 5 and the cutting of the recording medium 5 are performed on the platen 16. The platen 16 extends in the scanning direction Y. A guide rail 15 extending in the scanning direction Y is located above the platen 16.

Figure 2A:
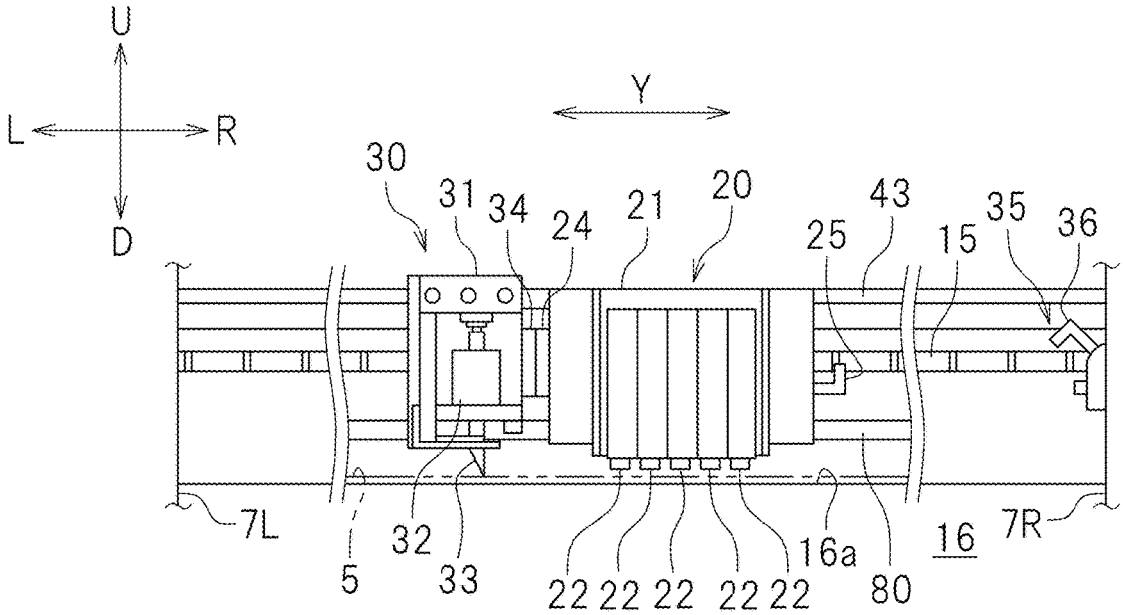
FIG. 2A is a front view of an inkjet head and a cutting head.

The inkjet head 20 performs the printing on the recording medium 5 placed on the platen 16. The inkjet head 20 is provided to face the carrying surface 16*a* of the platen 16. The inkjet head 20 is movable in the scanning direction Y. As shown in FIG. 2A, the inkjet head 20 includes a carriage 21 and a plurality of recording heads 22 each including a plurality of nozzles (not shown) discharging ink. In this preferred embodiment, five recording heads 22 are supported by the carriage 21. The five recording heads 22 respectively discharge different colors of ink, for example, yellow ink, magenta ink, cyan ink, black ink and white ink. The number of the recording heads 22 is not limited to five. There is no specific limitation on the colors of the ink to be discharged by the recording heads 22. The carriage 21 is supported by the guide rail 15. The carriage 21 is engaged with the guide rail 15 so as to be movable in the scanning direction Y.

The cutting head 30 cuts the recording medium 5 placed on the platen 16. The cutting head 30 is provided to face the carrying surface 16*a* of the platen 16. The cutting head 30 is movable in the scanning direction Y. As shown in FIG. 2A, the cutting head 30 includes a carriage 31, a solenoid 32, and a cutter 33. The cutter 33 is attached to the carriage 31 with the solenoid 32 being located between the cutter 33 and the carriage 31. The solenoid 32 is controlled by the controller 50 (see FIG. 1). When the solenoid 32 is turned on or off, the cutter 33 moves in an up-down direction to contact the recording medium 5 or to be separated away from the recording medium 5. The carriage 31 is supported by the guide rail 15. The carriage 31 is engaged with the guide rail 15 so as to be movable in the scanning direction Y.

The head moving mechanism 40 moves the carriage 21 of the inkjet head 20 and the carriage 31 of the cutting head 30 in the scanning direction Y with respect to the recording medium 5 placed on the platen 16. The head moving mechanism 40 moves the carriage 21 and the carriage 31 in the scanning direction Y. There is no specific limitation on the structure of the head moving mechanism 40. In this preferred embodiment, as shown in FIG. 1, the head moving mechanism 40 includes a pulley 41, a pulley 42, an endless belt 43, and a carriage motor 44. The pulley 41 is provided at a left end of the guide rail 15. The pulley 42 is provided at a right end of the guide rail 15. The belt 43 is wound along the pulley 41 and the pulley 42. The belt 43 is secured to a top portion of a rear surface of the carriage 31 (see FIG. 2A). The carriage motor 44 is connected with the right pulley 42. Alternatively, the carriage motor 44 may be connected with the left pulley 41. In this preferred embodiment, the carriage motor 44 is driven to rotate the pulley 42, and as a result, the belt 43 runs between the pulley 41 and the pulley 42. This causes the carriage 31 to move in the scanning direction Y. The carriage motor 44 is controlled by the controller 50.

As shown in FIG. 2A, a coupling member 24 made of a magnet is provided at a left end of the carriage 21. A coupling member 34 made of a magnet is secured to a right end of the carriage 31. The coupling member 24 is detachably coupled with the coupling member 34 of the cutting head 30. In this preferred embodiment, the coupling member 24 and the coupling member 34 are coupled with each other by use of a magnetic force. The coupling member 24 and the coupling member 34 are not limited to being coupled with each other by use of a magnetic force, and may have any other structure. For example, the coupling member 24 and the coupling member 34 may be engageable members. An L-shaped bracket 25 is provided at a right end of the carriage 21.

As shown in FIG. 2A, a left side frame 7L and a right side frame 7R are respectively located to the left and to the right of the platen 16. The guide rail 15 is supported by the left side frame 7L and the right side frame 7R. A lock device 35 locking the inkjet head 20 at a wait position is provided on the right side frame 7R. The lock device 35 includes a bracket 36, which may be hooked on the bracket 25, and a locking solenoid 37 (see FIG. 3) moving the bracket 36 between a lock position (see FIG. 2B) and a non-lock position (see FIG. 2A). The locking solenoid 37 is controlled by the controller 50.

Figure 2B:
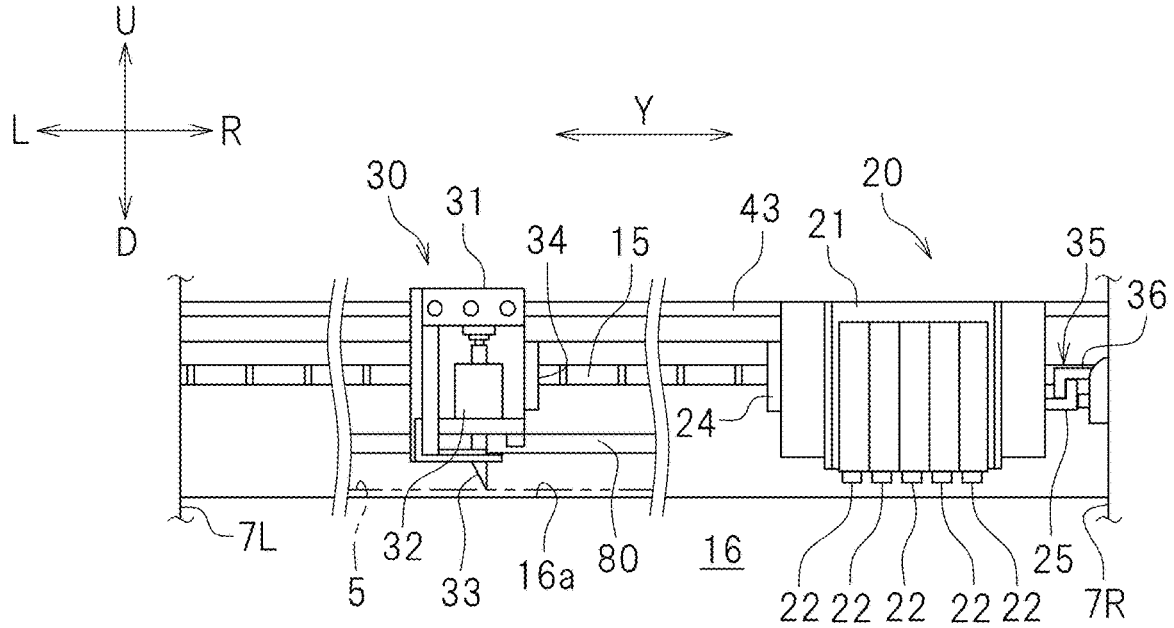
FIG. 2B is a front view of the inkjet head and the cutting head.

As shown in FIG. 2A, when the inkjet head 20 is to perform the printing, the bracket 36 is set at the non-lock position. When the carriage 31 of the cutting head 30 moves rightward and thus the coupling member 34 and the coupling member 24 contact each other, the carriage 31 and the carriage 21 are coupled with each other. As a result, the inkjet head 20 is movable in the left-right direction together with the cutting head 30. By contrast, when the cutting head 30 is to cut the recording medium 5, as shown in FIG. 2B, the inkjet head 20 is set at the wait position, and the bracket 36 of the lock device 35 is set at the lock position. This inhibits the inkjet head 20 from moving. When the carriage 31 moves leftward, the coupling member 34 and the coupling member 24 are separated from each other, and thus the carriage 31 and the carriage 21 are disengaged from each other. As a result, the cutting head 30 is made movable in the left-right direction while the inkjet head 20 waits at the wait position.

The transportation device 55 moves the recording medium 5 placed on the carrying surface 16*a* of the platen 16 in the transportation direction X. In this preferred embodiment, the transportation device 55 transports the recording medium 5 forward and rearward. Hereinafter, the forward direction of the transportation direction X will be referred to also as a "first transportation direction X1". The rearward direction of the transportation direction X will be referred to also as a "second transportation direction X2". The second transportation direction X2 is opposite to the first transportation direction X1. The transportation device 55 is provided to the rear of (on the second transportation direction X2 side with respect to) the inkjet head 20 and the cutting head 30. As shown in FIG. 4, the transportation device 55 includes grit rollers 57, a feed motor 58 (see FIG. 3), side pinch roller units 60, center pinch roller units 70, a first holding shaft 80, a rotator 81, and a center pinch roller moving mechanism 85.

Figure 3:
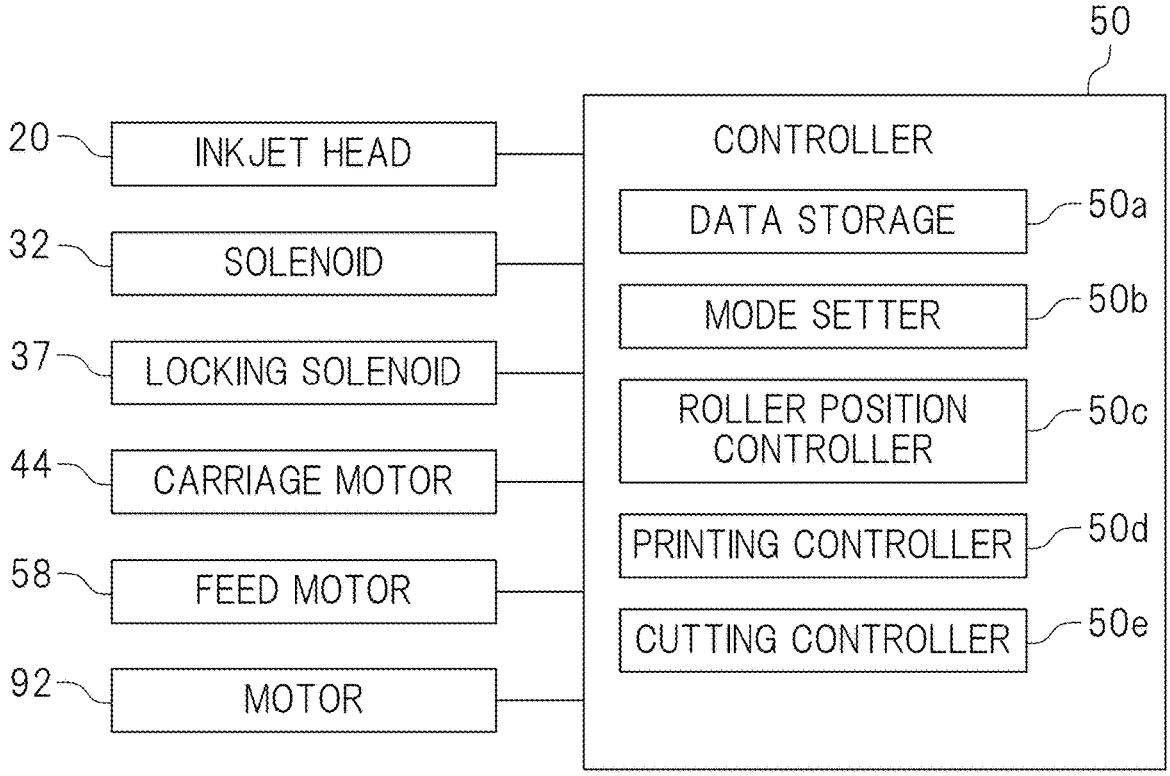
FIG. 3 is a block diagram of a control system of the cutting head-including printer according to a preferred embodiment of the present invention.
Figure 4:
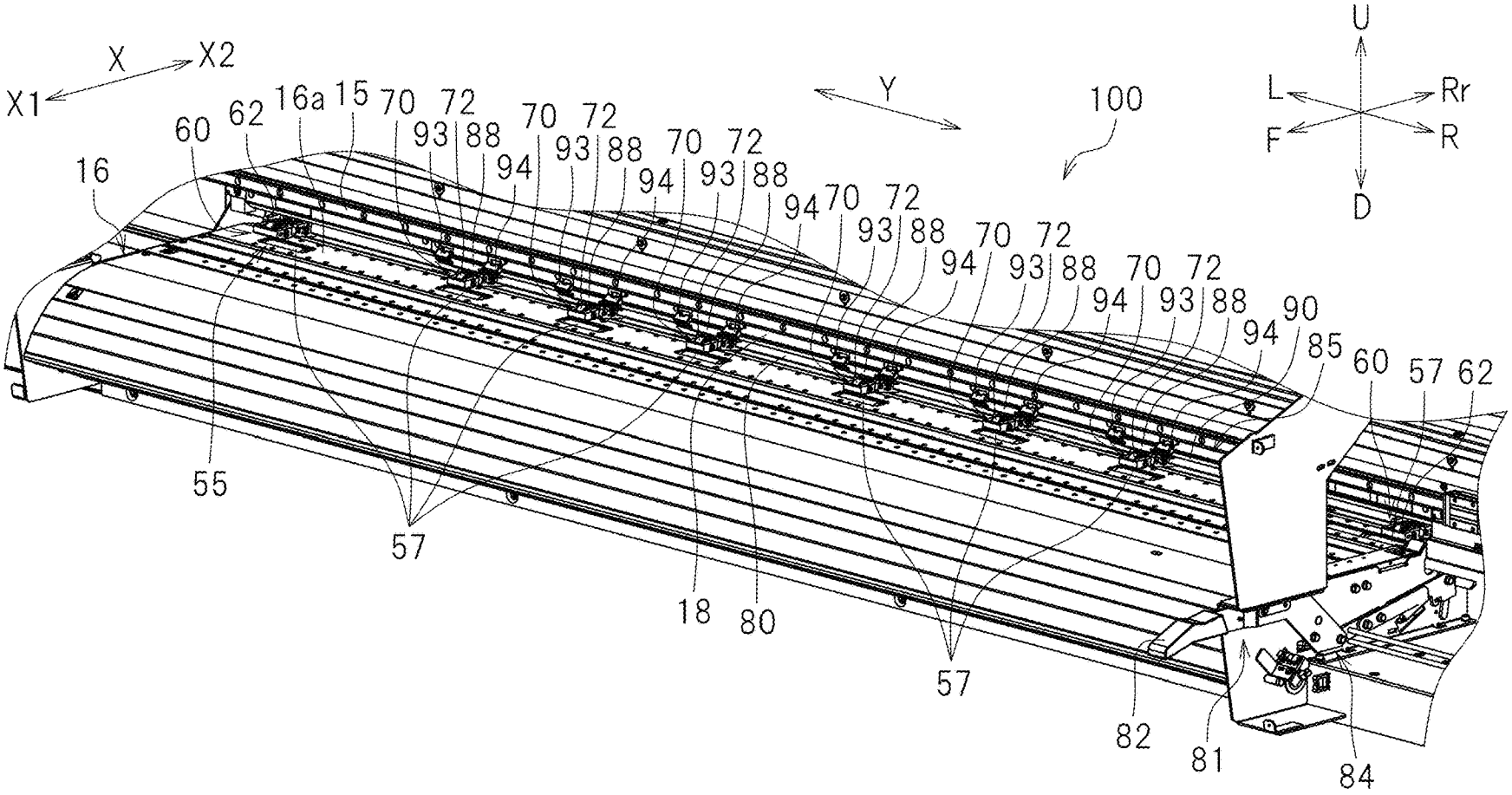
FIG. 4 is a perspective view of a portion of the cutting head-including printer according to a preferred embodiment of the present invention.
Figure 5:
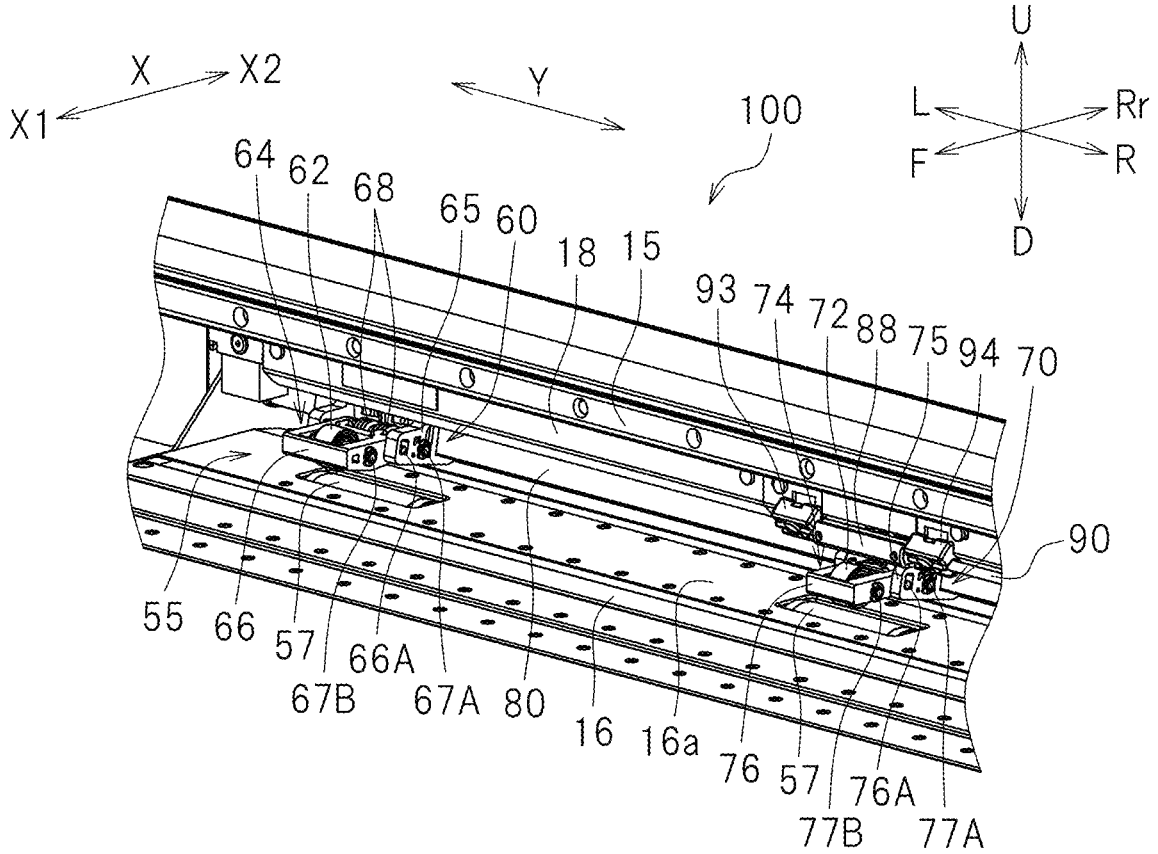
FIG. 5 is a perspective view showing a structure of a platen and the vicinity thereof according to a preferred embodiment of the present invention.

As shown in FIG. 4, the grit rollers 57 are provided in the platen 16. The grit rollers 57 are each embedded in the platen 16 such that a top portion thereof is exposed to the carrying surface 16*a*. In this preferred embodiment, the printer 100 includes eight grit rollers 57, for example. The number of the grit rollers 57 is not limited to eight. The grit rollers 57 are arrayed in the scanning direction Y. As shown in FIG. 5, some of the grit rollers 57 are located below side pinch rollers 62 described below. Such grit rollers 57 located below the side pinch rollers 62 hold the recording medium 5 such that the recording medium 5 is between such grit rollers 57 and the side pinch rollers 62. The other grit rollers 57 are located below center pinch rollers 72 described below. Such grit rollers 57 located below the center pinch rollers 72 hold the recording medium 5 such that the recording medium 5 is between such grit rollers 57 and the center pinch rollers 72. The feed motor 58 (see FIG. 3) is connected with the grit rollers 57. The feed motor 58 rotates the plurality of grit rollers 57 in the first transpiration direction X1 or the second transpiration direction X2 and thus transports the recording medium 5 in the transpiration direction X. The feed motor 58 is controlled by the controller 50. When the feed motor 58 is driven to rotate the grit rollers 57 in the state in which the recording medium 5 is held between the grit rollers 57 and the side pinch rollers 62 and between the grit rollers 57 and the center pinch rollers 72, the recording medium 5 is transferred in the transportation direction X.

Figure 6:
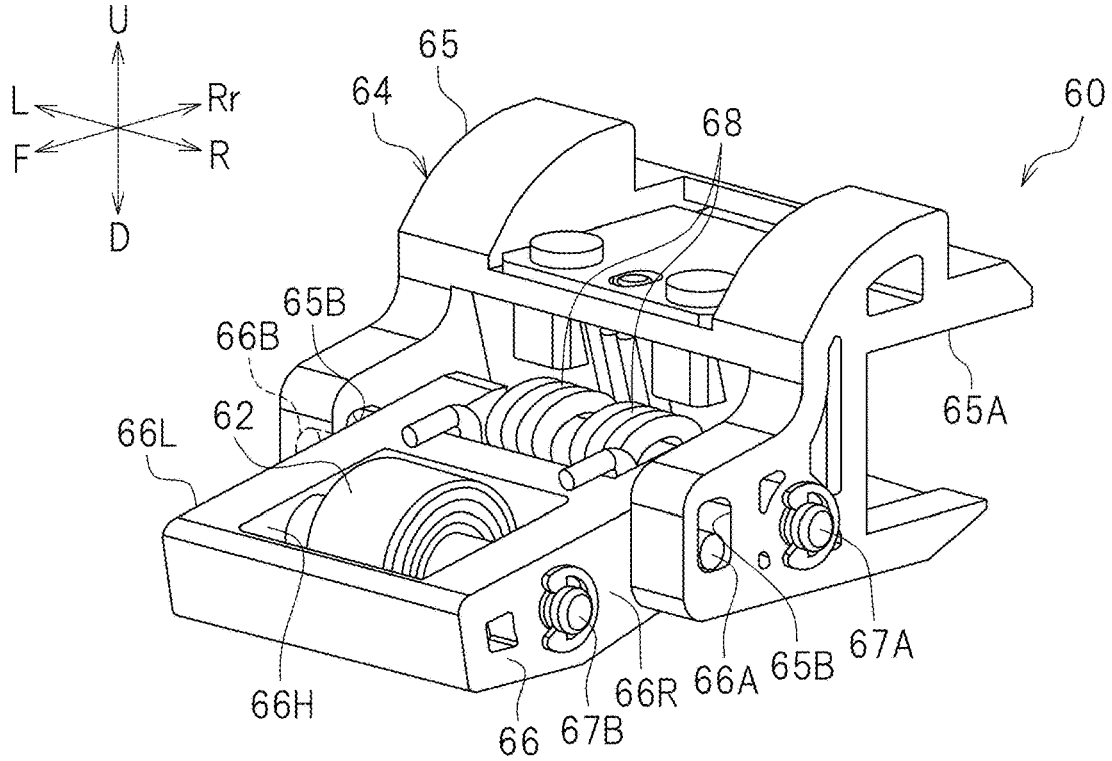
FIG. 6 is a perspective view of a side pinch roller unit according to a preferred embodiment of the present invention.

As shown in FIG. 6, the side pinch roller units 60 each include the side pinch roller 62 and a first holding member 64. The side pinch roller units 60 are located above the carrying surface 16*a* of the platen 16 (see FIG. 5). In this preferred embodiment, the printer 100 includes two side pinch roller units 60, for example. The side pinch roller units 60 are arrayed in the scanning direction Y. The pair of side pinch rollers 62 are respectively provided to face both of the two ends, in the scanning direction Y, of the carrying surface 16*a*. The side pinch roller 62 of each of the side pinch roller units 60 presses a corresponding end, in the scanning direction Y, of the recording medium 5 from above. As shown in FIG. 5, the side pinch rollers 62 are each located above the corresponding grit roller 57 so as to face the grit roller 57 in the up-down direction. The side pinch rollers 62 are made of, for example, rubber. The first holding member 64 of each side pinch roller unit 60 supports the side pinch roller 62 such that the side pinch roller 62 is rotatable. The first holding member 64 supports the side pinch roller 62 such that the side pinch roller 62 is movable in the up-down direction.

As shown in FIG. 6, the first holding member 64 includes a main body 65, an arm 66, a first shaft 67A, a second shaft 67B, and twisted coil springs 68. The main body 65 includes a recessed portion 65A, which is generally U-shaped as seen in a side view. A first holding shaft 80 (see FIG. 4) described below is fit into the recessed portion 65A. The main body 65 includes the first shaft 67A supporting the arm 66 such that the arm 66 is rotatable. The main body 65 includes openings 65B extending in the up-down direction.

As shown in FIG. 6, a first protrusion 66A protruding rightward is provided on a right side surface 66R of the arm 66. The first protrusion 66A is inserted into one of the openings 65B. A second protrusion 66B protruding leftward is provided on a left side surface 66L of the arm 66. The second protrusion 66B is inserted into the other opening 65B. The first protrusion 66A and the second protrusion 66B are movable in the up-down direction in the openings 65B. Therefore, the side pinch roller 62 is movable in the up-down direction in accordance with the thickness of the recording medium 5. The arm 66 includes an opening 66H, in which the side pinch roller 62 is accommodated. The second shaft 67B, supporting the side pinch roller 62 such that the side pinch roller 62 is rotatable, is provided in the arm 66 so as to extend through the opening 66H.

As shown in FIG. 6, the twisted coil springs 68 are wound around the first shaft 67A. The twisted coil springs 68 are locked on the arm 66. The twisted coil springs 68 urge the arm 66 downward. In this preferred embodiment, there are two twisted coil springs 68, for example. The number of the twisted coil springs 68 is not limited to two.

Figure 7:
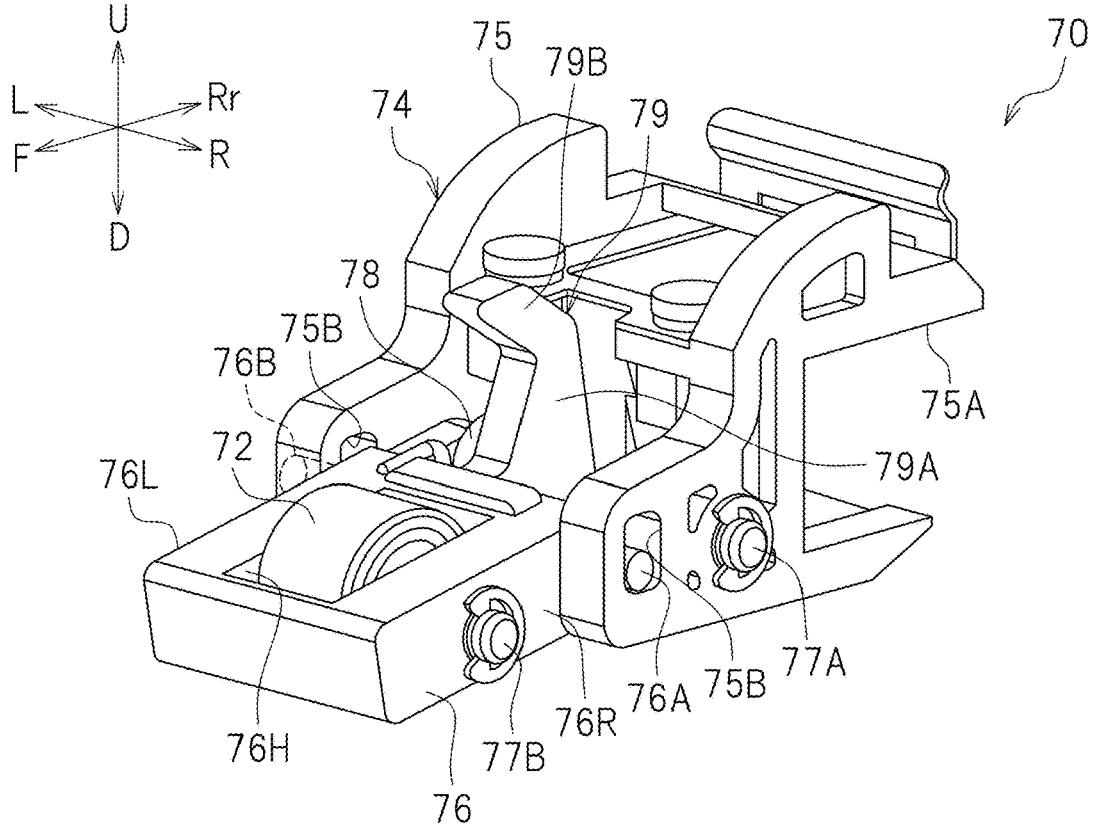
FIG. 7 is a perspective view of a center pinch roller unit according to a preferred embodiment of the present invention.

As shown in FIG. 7, the center pinch roller units 70 each include the center pinch roller 72 and a second holding member 74. The center pinch roller units 70 are located above the platen 16 (see FIG. 1). The center pinch roller units 70 are provided between the pair of side pinch roller units 60, and face the carrying surface 16*a* of the platen 16. In this preferred embodiment, the printer 100 includes six center pinch roller units 70, for example. The number of the center pinch roller units 70 is not limited to six. The center pinch roller units 70 are arrayed in the scanning direction Y. The center pinch rollers 72 each press the recording medium 5 from above. As shown in FIG. 5, the center pinch roller 72 of each center pinch roller unit 70 is located above the corresponding grit roller 57 so as to face the grit roller 57 in the up-down direction. The center pinch rollers 72 are made of, for example, rubber. The second holding member 74 of each center pinch roller unit 70 supports the center pinch roller 72 such that the center pinch roller 72 is rotatable. The second holding member 74 supports the center pinch roller 72 such that the center pinch roller 72 is movable in the up-down direction.

As shown in FIG. 7, the second holding member 74 includes a main body 75, an arm 76, a first shaft 77A, a second shaft 77B, and a twisted coil spring 78. As shown in FIG. 7, the main body 75 includes a recessed portion 75A, which is generally U-shaped as seen in a side view. The first holding shaft 80 (see FIG. 4) described below is fit into the recessed portion 75A. The main body 75 includes the first shaft 77A supporting the arm 76 such that the arm 76 is rotatable. The main body 75 includes openings 75B extending in the up-down direction.

As shown in FIG. 7, a first protrusion 76A protruding rightward is provided on a right side surface 76R of the arm 76. The first protrusion 76A is inserted into one of the openings 75B. A second protrusion 76B protruding leftward is provided on a left side surface 76L of the arm 76. The second protrusion 76B is inserted into the other opening 75B. The first protrusion 76A and the second protrusion 76B are movable in the up-down direction in the openings 75B. Therefore, the center pinch roller 72 is movable in the up-down direction in accordance with the thickness of the recording medium 5. The arm 76 includes an opening 76H, in which the center pinch roller 72 is accommodated. The second shaft 77B, supporting the center pinch roller 72 such that the center pinch roller 72 is rotatable, is provided in the arm 76 so as to extend through the opening 76H.

Figure 8:
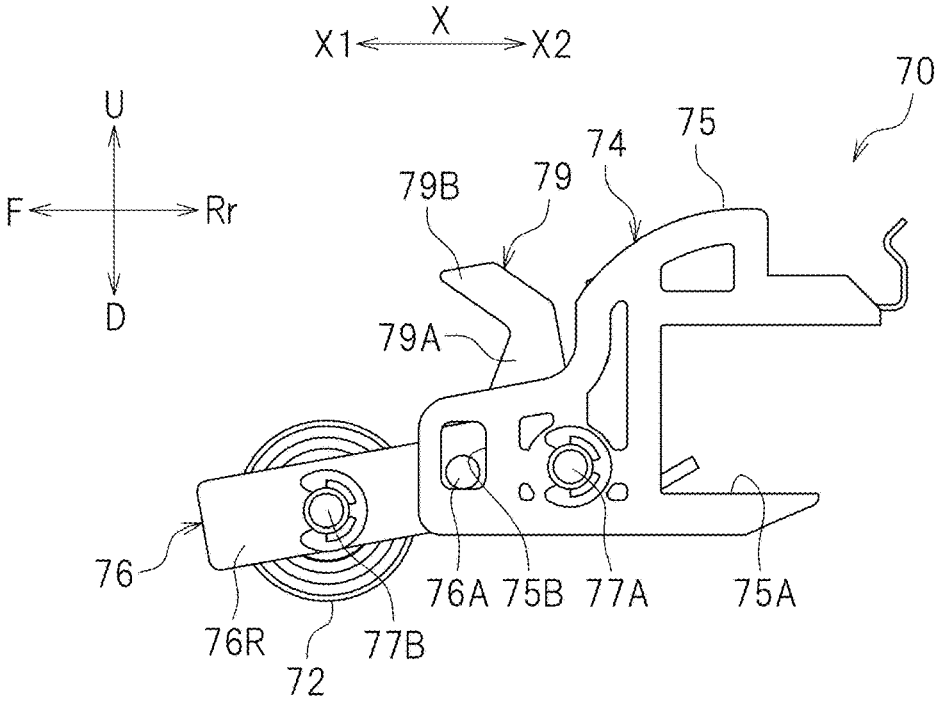
FIG. 8 is a side view of the center pinch roller unit according to a preferred embodiment of the present invention.
Figure 9:
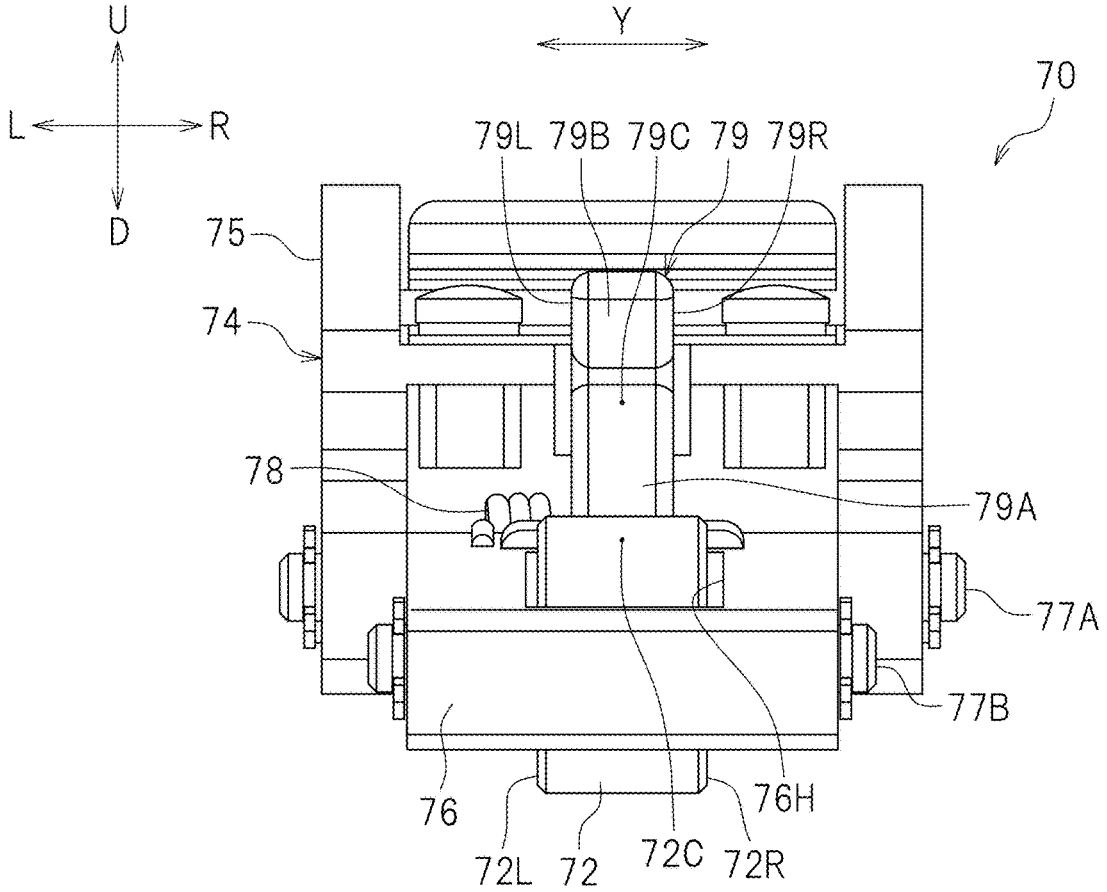
FIG. 9 is a front view of the center pinch roller unit according to a preferred embodiment of the present invention.

As shown in FIG. 8, the second holding member 74 includes a stopping member 79 provided on the arm 76. The stopping member 79 is allowed to contact an eccentric cam 88 (see FIG. 4) described below. The stopping member 79 is located to the rear of the center pinch roller 72. The stopping member 79 extends obliquely upward toward the center pinch roller 72. The stopping member 79 includes a first portion 79A extending obliquely in a rearward and upward direction from a rear end of the arm 76, and a second portion 79B extending obliquely in a forward and upward direction from a top end of the first portion 79A. As shown in FIG. 9, a left end 79L of the stopping member 79 is located to the right of a left end 72L of the center pinch roller 72 as seen in a front view. A right end 79R of the stopping member 79 is located to the left of a right end 72R of the center pinch roller 72 as seen in a front view. In this preferred embodiment, a center 79C of the stopping member 79 in the scanning direction Y and a center 72C of the center pinch roller 72 in the scanning direction Y match each other. The stopping member 79 is made of, for example, zinc by die-casting.

As shown in FIG. 9, the twisted coil spring 78 is wound around the first shaft 77A. The twisted coil spring 78 is located to the left of the stopping member 79. Alternatively, the twisted coil spring 78 may be located to the right of the stopping member 79. The twisted coil spring 78 is locked on the arm 76. The twisted coil spring 78 urges the arm 76 downward. The twisted coil spring 78 has a stress smaller than a stress of each of the twisted coil springs 68 used in the side pinch roller units 60. In this preferred embodiment, there is one twisted coil spring 78. There may be any other number of twisted coil springs 78.

Figure 10:
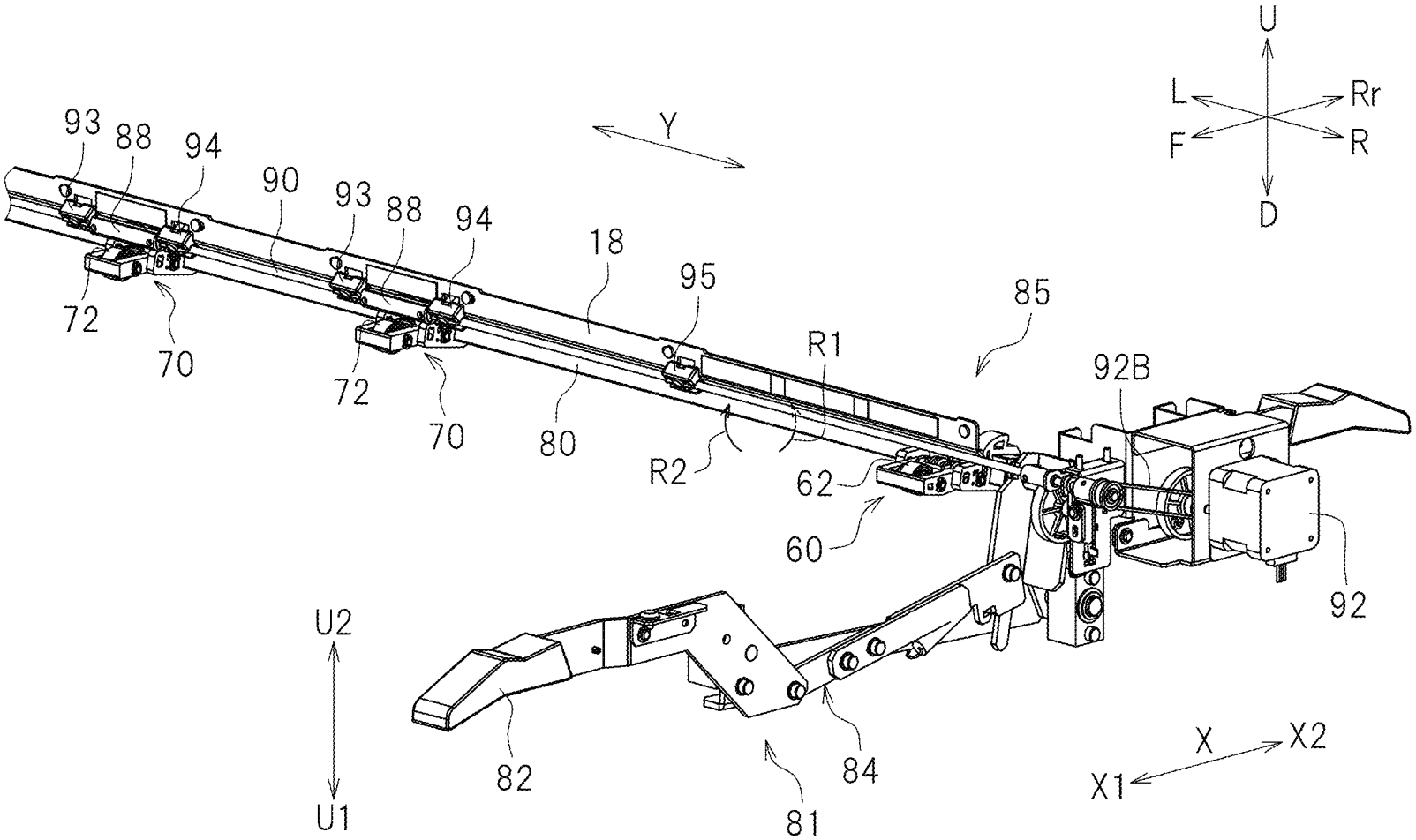
FIG. 10 is a perspective view of a center pinch roller moving mechanism and a rotator according to a preferred embodiment of the present invention.
Figure 11:
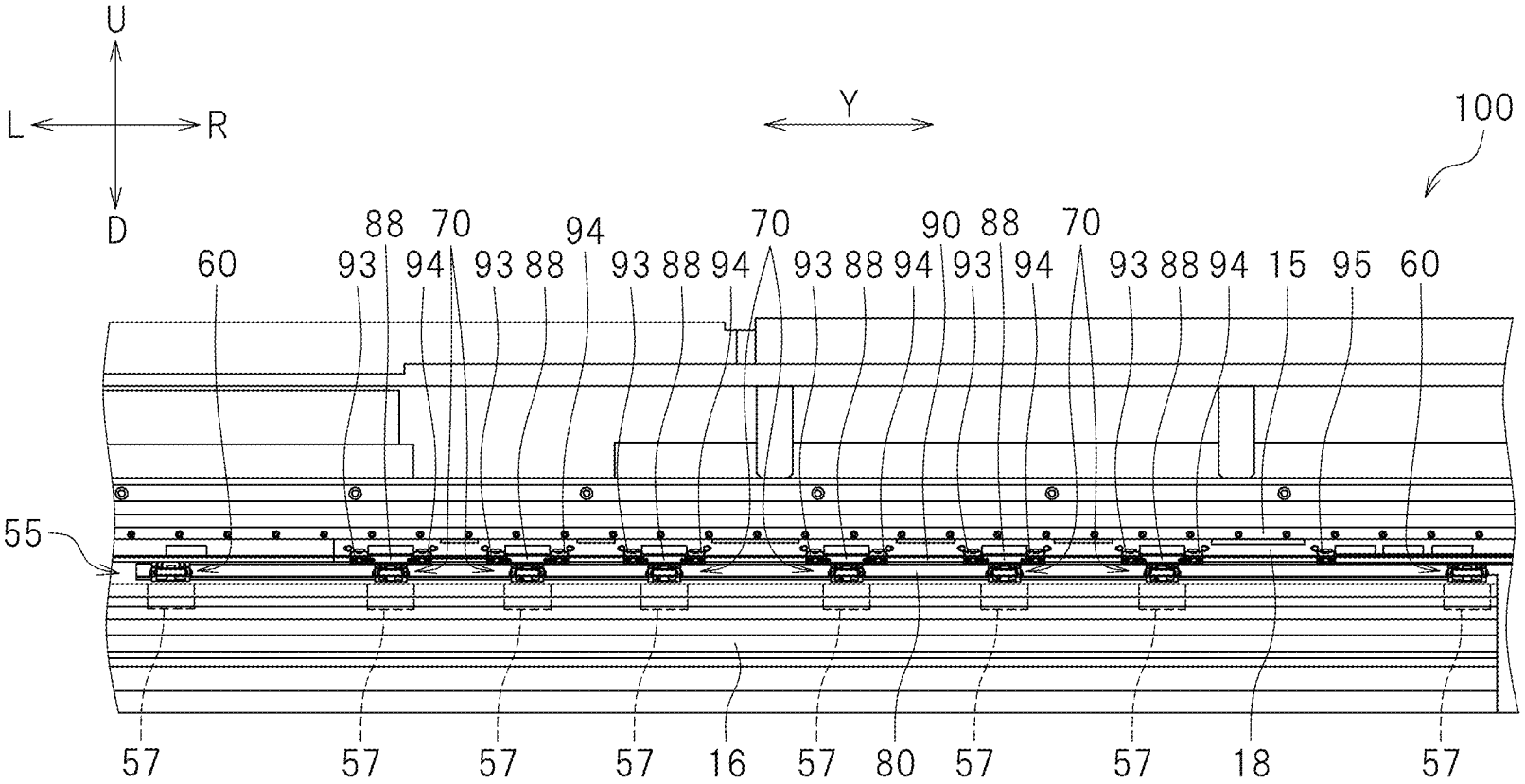
FIG. 11 is a front view of a portion of the cutting head-including printer according to a preferred embodiment of the present invention.
Figure 12:
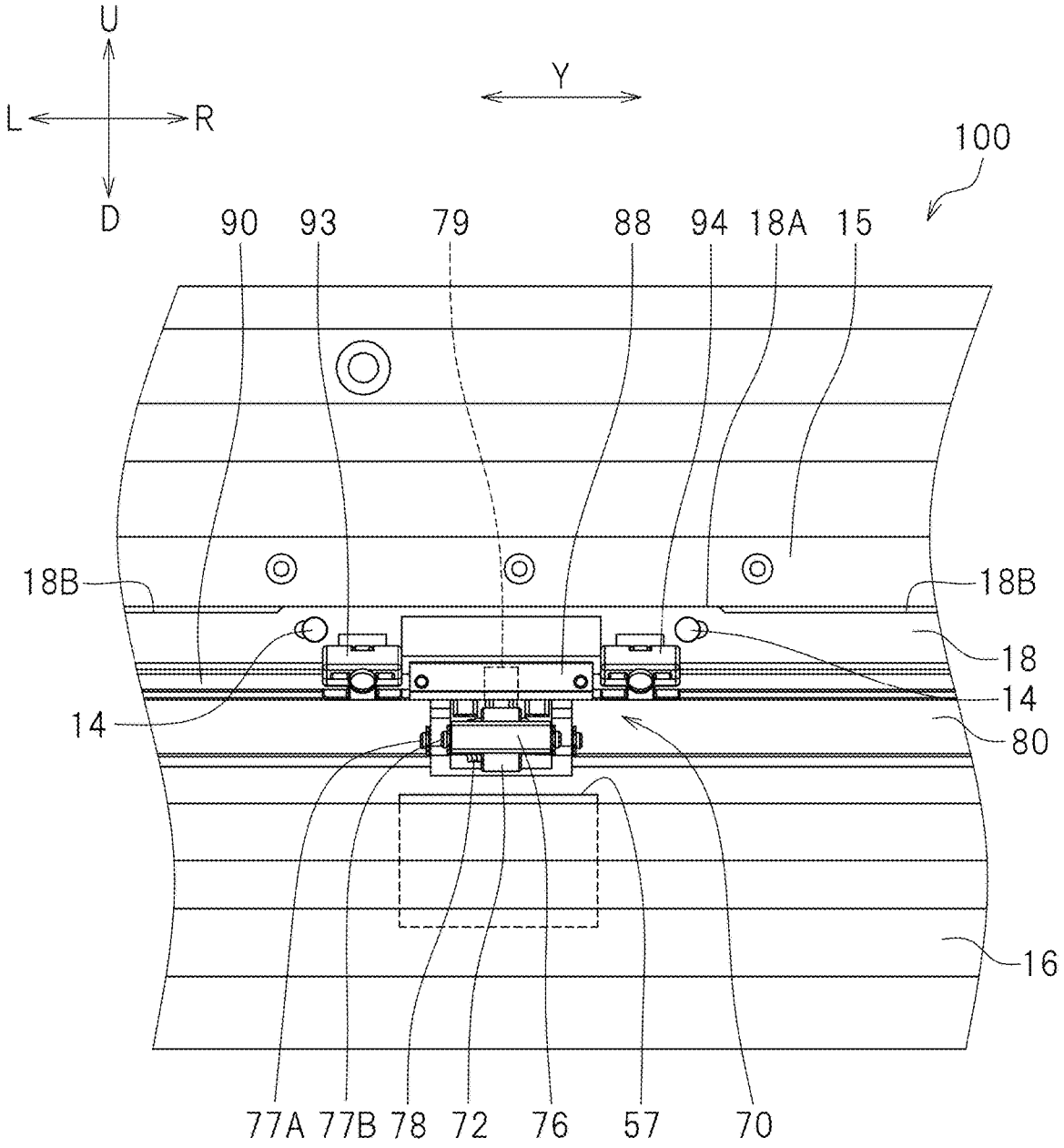
FIG. 12 is a front view showing a structure of the center pinch roller unit and the vicinity thereof according to a preferred embodiment of the present invention.
Figure 13:
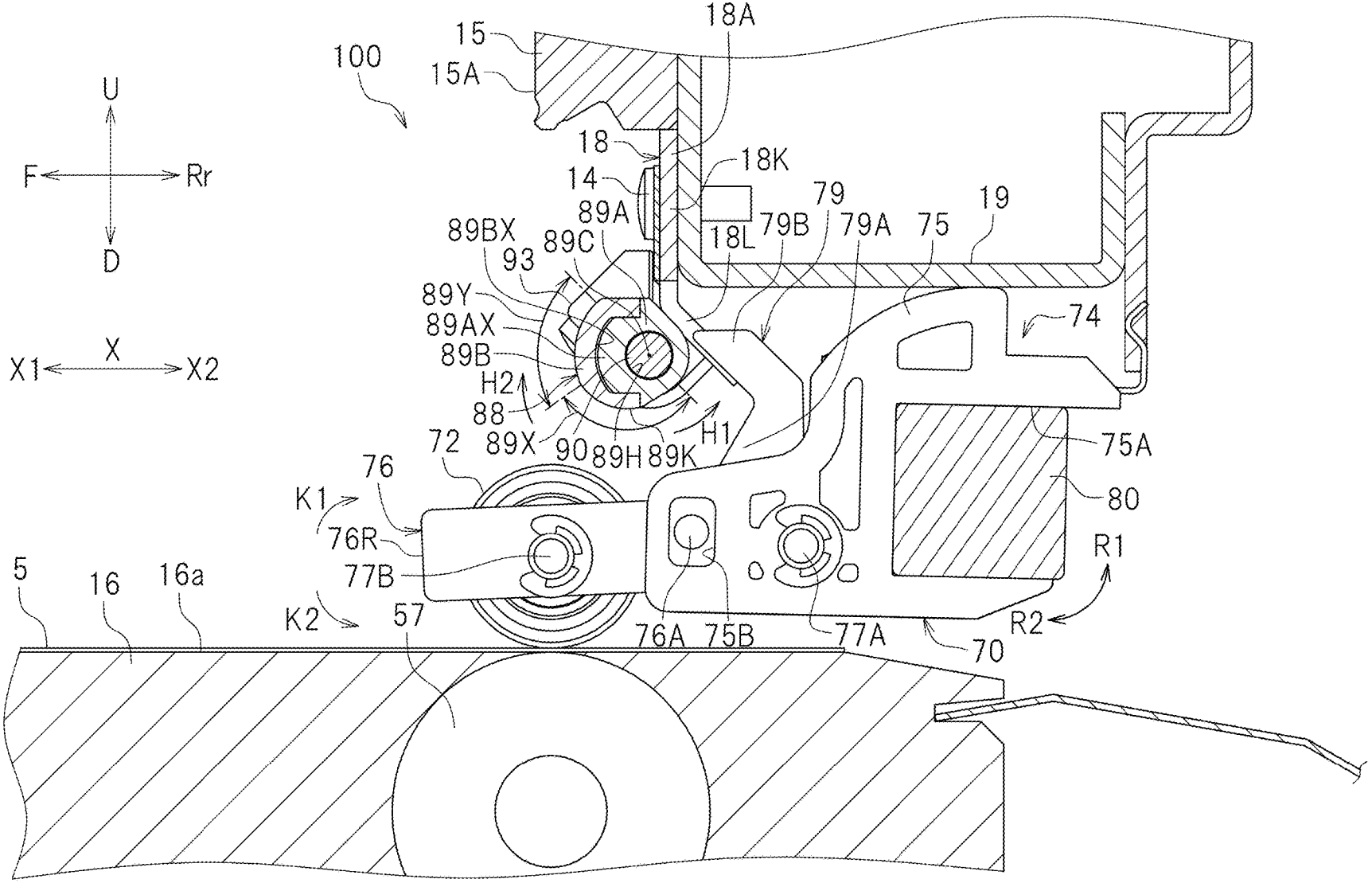
FIG. 13 is a partially cut cross-sectional view showing a structure of the center pinch roller unit and the vicinity thereof according to a preferred embodiment of the present invention.

As shown in FIG. 10, the first holding shaft 80 extends in the scanning direction Y. As shown in FIG. 11, the first holding shaft 80 is located below the guide rail 15. As shown in FIG. 12, the first holding shaft 80 is located below a frame member 18 described below. The first holding shaft 80 is located above the platen 16. As shown in FIG. 13, the first holding shaft 80 has a rectangular cross-section. As shown in FIG. 11, the first holding shaft 80 holds the side pinch roller units 60 and the center pinch roller units 70. In more detail, the first holding shaft 80 is fit into the recessed portion 65A provided in the main body 65 of the first holding member 64 of each of the side pinch roller units 60. The first holding shaft 80 is fit into the recessed portion 75A provided in the main body 75 of the second holding member 74 of each of the center pinch roller units 70. The side pinch roller units 60 and the center pinch roller units 70 are slidable with respect to the first holding shaft 80 so as to be changed in the position thereof in the scanning direction Y. Therefore, in the case where the recording medium 5 has a width in the scanning direction Y that is smaller than a width of the carrying surface 16*a* of the platen 16, one of, or both of, the pair of side pinch rollers may be moved toward the center of the carrying surface 16*a* to align the positions of the side pinch rollers 62 in the scanning direction Y to the position of the recording medium 5. As a result, the side pinch rollers 62 may be located at positions facing both of the two ends, in the scanning direction Y, of the recording medium 5 and press the two ends of the recording medium 5.

As shown in FIG. 1, the rotator 81 is located to the right of the platen 16. As shown in FIG. 10, the rotator 81 rotates the first holding shaft 80 in a direction of arrow R1 and a direction of arrow R2 in FIG. 10. The rotator 81 includes a loading lever 82 and a link mechanism 84. The loading lever 82 is provided at a front end of the link mechanism 84. A rear end of the link mechanism 84 is connected with the first holding shaft 80. When the loading lever 82 is pushed down in a direction of arrow U1 in FIG. 10, the first holding shaft 80 is rotated in the direction of arrow R1 in FIG. 10. As a result, the side pinch rollers 62 and the center pinch rollers 72 approach the grit rollers 57 (see FIG. 4). The operator places the recording medium 5 on the platen 16 and then pushes down the loading lever 82 in the direction of arrow U1 in FIG. 10, and thus causes the recording medium 5 to be held between the side pinch rollers 62/the center pinch rollers 72 and the grit rollers 57. By contrast, when the loading lever 82 is pushed up in a direction of arrow U2 in FIG. 10, the first holding shaft 80 is rotated in the direction of arrow R2 in FIG. 10. As a result, the side pinch rollers 62 and the center pinch rollers 72 are separated from the grit rollers 57. When the printing is finished or the cutting is finished, the operator pushes up the loading lever 82 in the direction of arrow U2 in FIG. 10, and thus causes the recording medium 5 to be removed from the platen 16.

As shown in FIG. 10, the center pinch roller moving mechanism 85 is located above the first holding shaft 80. The center pinch roller moving mechanism 85 allows the center pinch rollers 72 to approach, or to be separated from, the grit rollers 57. In more detail, the center pinch roller moving mechanism 85 moves the center pinch rollers 72 to positions at which the center pinch rollers 72 hold the recording medium 5 placed on the carrying surface 16*a* of the platen 16 together with the grit rollers 57 facing the center pinch rollers 72 (hereinafter, these positions will be referred to also as "holding positions"). The center pinch roller moving mechanism 85 also moves the center pinch rollers 72 to positions at which the center pinch rollers 72 are separated from the grit rollers 57 (hereinafter, these positions will be referred to also as "separation positions"). The center pinch roller moving mechanism 85 includes a second holding shaft 90, a plurality of the eccentric cams 88, a motor 92, first support members 93, second support members 94 and a third support member 95.

As shown in FIG. 10, the second holding shaft 90 extends in the scanning direction Y. As shown in FIG. 13, the second holding shaft 90 is located below the guide rail 15. The second holding shaft 90 is located to the rear of a front end 15A of the guide rail 15. The second holding shaft 90 is located above the platen 16. The second holding shaft 90 is parallel to the first holding shaft 80. The second holding shaft 90 is located above the first holding shaft 80. The second holding shaft 90 is located to the front of the first holding shaft 80. The second holding shaft 90 is located to the rear of the center pinch rollers 72. The second holding shaft 90 is located to the rear of the second axis 77B of each of the center pinch roller units 70. The second holding shaft 90 has a circular cross-section. The second holding shaft 90 holds the eccentric cams 88. The second holding shaft 90 is made of a metal material.

Figure 14:
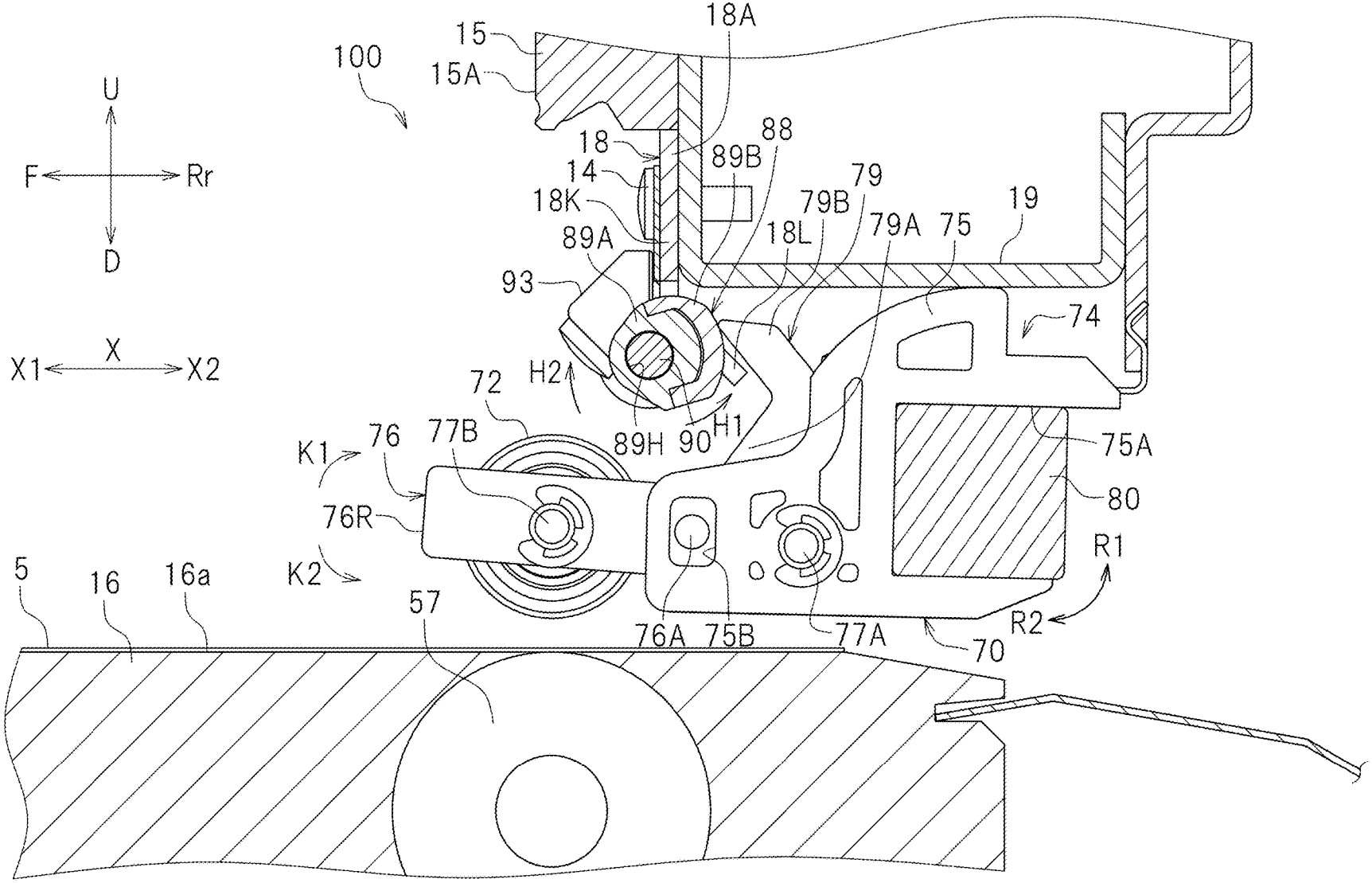
FIG. 14 is a partially cut cross-sectional view showing a structure of the center pinch roller unit and the vicinity thereof according to a preferred embodiment of the present invention.

As shown in FIG. 14, the eccentric cams 88 are each allowed to contact the stopping member 79 of the second holding member 74. The eccentric cam 88 contacts the stopping member 79 to move the corresponding center pinch roller 72 upward. This will be described in more detail. The eccentric cam 88 contacts the stopping member 79, and as a result, the stopping member 79 is pushed up. Since the stopping member 79 is formed on the arm 76, the arm 76 is rotated in a direction of arrow K1 shown in FIG. 13 as being centered around the first shaft 77A. As a result, the center pinch roller 72 rotatably supported by the second shaft 77B provided on the arm 76 is moved upward, and thus is separated from the grit roller 57 (see FIG. 14). The eccentric cam 88 is located above the grit roller 57. The eccentric cam 88 is located to the rear of the front end 15A of the guide rail 15. As shown in FIG. 13, while the second holding shaft 90 is not rotating, the eccentric cam 88 and the second holding member 74 are out of contact with each other.

As shown in FIG. 13, the distance between a rotation center 89C and an outer circumferential surface 89K of the eccentric cam 88 is not constant in the entirety of the circumference of the eccentric cam 88. The eccentric cam 88 includes a first portion 89X and a second portion 89Y. In the first portion 89X, the distance between the rotation center 89C and the outer circumferential surface 89K gradually increases. In the second portion 89Y, the distance between the rotation center 89C and the outer circumferential surface 89K is longer than in the first portion 89X and is constant. The eccentric cam 88 contacts the stopping member 79 of the second holding member 74 in the first portion 89X and then contacts the second holding member 74 in the second portion 89Y.

As shown in FIG. 13, the eccentric cam 88 includes a first member 89A and a second member 89B. The first member 89A includes an insertion hole 89H, into which the second holding shaft 90 is inserted. The first member 89A rotates integrally with the second holding shaft 90. The first member 89A is made of a metal material. The first member 89A and the second holding shaft 90 are secured to each other via, for example, a screw. The second member 89B is made of, for example, a resin material. The second member 89B is allowed to contact the stopping member 79 of the second holding member 74. The second member 89B includes a recessed portion 89BX. A protrusion 89AX of the first member 89A is fit into the recessed portion 89BX, and thus the second member 89B is attached to the first member 89A.

As shown in FIG. 10, the motor 92 is connected with a right end of the second holding shaft 90 via a belt 92B. The motor 92 and the belt 92B are located to the right of the platen 16. Alternatively, the motor 92 and the belt 92B may be located to the left of the platen 16. In the latter case, the motor 92 may be connected with a left end of the second holding shaft 90 via the belt 92B. The motor 92 is controlled by the controller 50 (see FIG. 3). The motor 92 is driven to run the belt 92B, and as a result, the second holding shaft 90 rotates. As shown in FIG. 13, the second holding shaft 90 may be rotated in a direction of arrow H1 in FIG. 13, so that the eccentric cam 88 contacts the stopping member 79 of the second holding member 74. By contrast, the second holding shaft 90 may be rotated in a direction of arrow H2 in FIG. 13, so that the eccentric cam 88 is separated away from the stopping member 79 of the second holding member 74.

In the above-described preferred embodiments, the driving force of the motor 92 is transmitted to the second holding shaft 90 via the belt 92B. The manner of transmission is not limited to this. The motor 92 may be directly connected with the second holding shaft 90.

Figure 15:
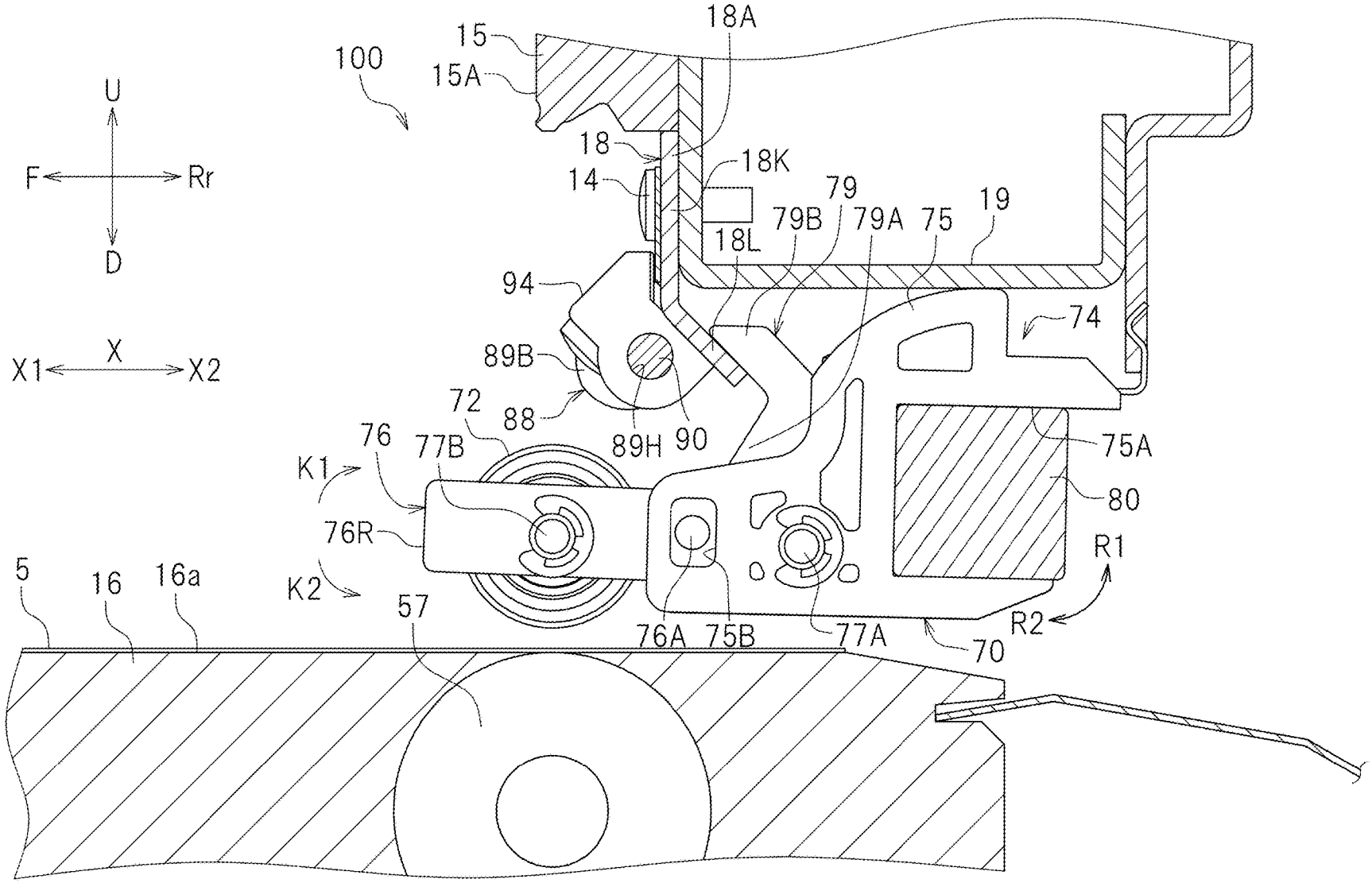
FIG. 15 is a partially cut cross-sectional view showing a structure of the center pinch roller unit and the vicinity thereof according to a preferred embodiment of the present invention.

As shown in FIG. 4, the frame member 18 is provided below the guide rail 15. The frame member 18 extends in the scanning direction Y. As shown in FIG. 12, the frame member 18 includes a protrusion 18A in contact with the guide rail 15 and a recessed portion 18B out of contact with the guide rail 15. The eccentric cam 88 is located between a left end and a right end of the protrusion 18A of the frame member 18. As shown in FIG. 15, the frame member 18 is secured, via a screw 14, to the main body frame 19, to which the guide rail 15 is secured. The frame member 18 includes a vertical wall 18K extending in the up-down direction and an inclining wall 18L extending obliquely in a rearward and downward direction from a bottom end of the vertical wall 18K. As shown in FIG. 13, the inclining wall 18L is not present to the rear of the eccentric cam 88. The inclining wall 18L is not present above the grit roller 57. The inclining wall 18L inhibits the center pinch rollers 72 from moving downward. Namely, when the grit rollers 57 are not present below the center pinch rollers 72 and the first holding shaft 80 rotates in the direction of arrow R1 in FIG. 15, the inclining wall 18L contacts the stopping member 79 of the second holding member 74. Therefore, the arm 76 of the second holding member 74 is prevented from rotating in the direction of arrow K2 in FIG. 15 as being centered around the first shaft 77A. For this reason, even if the first holding shaft 80 rotates in the direction of arrow R1 in FIG. 15, the center pinch rollers 72 do not move downward. Namely, the center pinch rollers 72 and the grit rollers 57 do not contact each other.

As shown in FIG. 11, the first support members 93, the second support members 94 and the third support member 95 support the second holding shaft 90. The first support members 93, the second support members 94 and the third support member 95 are attached to the frame member 18. The first support members 93 are each located to the left of the corresponding eccentric cam 88. The second support members 94 are each located to the right of the corresponding eccentric cam 88. The third support member 95 is located between one of the side pinch roller units 60 and the center pinch roller unit 70 adjacent to the one side pinch roller unit 60.

As shown in FIG. 3, the controller 50 controls the printing on the recording medium 5 and the cutting of the recording medium 5. There is no specific limitation on the structure of the controller 50. The controller 50 is, for example, a microcomputer. There is no specific limitation on the hardware structure of the microcomputer. The microcomputer includes, for example, an I/F, a CPU, a ROM, a RAM and a storage device. As shown in FIG. 1, the controller 50 is provided in the main body 100*a*. The controller 50 does not need to be provided in the main body 100*a*. The controller 50 may be, for example, a computer provided outside the main body 100*a*. In this case, the controller 50 is communicably connected with the main body 100*a* in a wired or wireless manner. The controller 50 is electrically connected with, and controls an operation of, the inkjet head 20, the solenoid 32, the locking solenoid 37, the carriage motor 44, the feed motor 58 and the motor 92.

As shown in FIG. 3, the controller 50 includes a data storage 50*a*, a mode setter 50*b*, a roller position controller 50*c*, a printing controller 50*d*, and a cutting controller 50*e*. The controller 50 may include any other controller but such controllers will not be described herein.

The data storage 50*a* stores working data. The working data includes at least one of printing data and cutting data. The printer 100 executes the printing or the cutting based on the working data stored on the data storage 50*a*. In the case where the working data includes only the printing data, the printer 100 executes only the printing. In the case where the working data includes only the cutting data, the printer 100 executes only the cutting. In the case where the working data includes both of the printing data and the cutting data, the printer 100 executes the printing and the cutting.

The mode setter 50*b* sets a working mode in which the printing and the cutting are to be performed. The mode setter 50*b* sets a working mode in which the printing and the cutting are executed to one of a first working mode and a second working mode. In the first working mode, the printing is first executed and then the cutting is executed. In the second working mode, the cutting is first executed and then the printing is executed. In this preferred embodiment, in the case where the printing data is written before the cutting data in the working data, the mode setter 50*b* sets the working mode to the first working mode. In the case where the cutting data is written before the printing data in the working data, the mode setter 50*b* sets the working mode to the second working mode.

The roller position controller 50*c* controls the center pinch roller moving mechanism 85, more specifically, the motor 92, to control the movement of the center pinch rollers 72 in the up-down direction. The roller position controller 50*c* controls the positions of the center pinch rollers 72 during the cutting in accordance with the working mode set by the mode setter 50*b*. In the case where the working mode is set to the first working mode, the roller position controller 50*c* locates the center pinch rollers 72 at the separated positions during the cutting. In the case where the working mode is set to the second working mode, the roller position controller 50*c* locates the center pinch rollers 72 at the holding positions during the cutting.

The printing controller 50*d* controls a printing operation. The printing controller 50*d* controls the driving of the carriage motor 44 to control the rotation of the pulley 42 and the running of the belt 43 (see FIG. 1). In this manner, the printing controller 50*d* controls the movement of the inkjet head 20 and the cutting head 30 in the scanning direction Y. The printing controller 50*d* controls the driving of the feed motor 58 to control the rotation of the grit rollers 57. In this manner, the printing controller 50*d* controls the movement of the recording medium 5 placed on the platen 16 in the transportation direction X. The printing controller 50*d* controls the timing at which the inkjet head 20 injects the ink, the amount of the ink to be injected, and the like. With such controls, the printing controller 50*d* prints an image on the recording medium 5.

The cutting controller 50*e* controls a cutting operation. The cutting controller 50*e* controls the solenoid 32 to control the movement of the cutter 33 in the up-down direction and the pressure of the cutter 33. The cutting controller 50*e* controls the driving of the carriage motor 44 to control the movement of the cutting head 30 in the scanning direction Y. The cutting controller 50*e* controls the driving of the feed motor 58 to control the movement of the recording medium 5 placed on the platen 16 in the transportation direction X. With such controls, the cutting controller 50*e* cuts the recording medium 5.

Hereinafter, a work performed by the printer 100 in the case where the working data includes both of the printing data and the cutting data will be described. First, input of the working data and the setting of the working mode will be described, and then, the setting of the recording medium 5 will be described. After that, the case where the printing and the cutting are executed in the first working mode (the printing is first performed, and then, the cutting is performed) and the case where the printing and the cutting are executed in the second working mode (the cutting is first performed, and then, the printing is performed) will be described.

The working data is, for example, transmitted from an external computer or the like connected with the printer 100 to the data storage 50*a* together with an execution instruction. In this preferred embodiment, the data storage 50*a* temporarily stores the working data to be executed.

The mode setter 50*b* sets the working mode in which the printing and the cutting are to be executed, based on the working data stored on the data storage 50*a*. In the case of including the printing data and the cutting data, the working data has one of the printing data and the cutting data written therein first and the other of the printing data and the cutting data written thereafter. In the case where the printing data is written in the working data before the cutting data, the mode setter 50*b* sets the working mode to the first working mode. In the case where the cutting data is written in the working data before the printing data, the mode setter 50*b* sets the working mode to the second working mode. In other words, the mode setter 50*b* sets the working mode such that the printing and the cutting are executed in the order of being written in the working data.

The recording medium 5 is set to the printer 100 by the operator. As shown in FIG. 4, when the recording medium 5 is to be placed on the platen 16, the side pinch rollers 62 and the center pinch rollers 72 are separated from the grit rollers 57. When the positional alignment of the recording medium 5 and the platen 16 is finished, the operator pushes down the loading lever 82 in the direction of arrow U1 in FIG. 10. As a result, the first holding shaft 80 rotates in the direction of arrow R1 in FIG. 10. The first holding shaft 80 holds the first holding members 64 and the second holding members 74. Therefore, the first holding members 64 and the second holding members 74 also rotate in the direction of arrow R1 in FIG. 10. Thus, the side pinch rollers 62 and the center pinch rollers 72 approach the grit rollers 57. As a result, the recording medium 5 is held between the side pinch rollers 62 and the grit rollers 57 and between the center pinch rollers 72 and the grit rollers 57 (see FIG. 13).

(First Working Mode)

In the case where the first working mode is set based on the working data, the printing is first performed, and then, the cutting is performed. The printing is performed while the recording medium 5 is intermittently transported in the first transportation direction X1. Before the printing, the inkjet head 20 and the cutting head 30 are coupled with each other. During the printing, the printer 100 controls the carriage motor 44 to run the inkjet head 20 in the scanning direction Y while controlling the inkjet head 20 to eject the ink. When the printing on a portion of the recording medium 5 that is below the inkjet head 20 is finished, the recording medium 5 is transported in the first transportation direction X1. These operations are repeated, and thus the printing of an image on the recording medium 5 is finished.

During the printing, the center pinch rollers 72 are located at the holding positions. During the printing, the center pinch rollers 72 hold the recording medium 5 together with the grit rollers 57 facing the center pinch rollers 72. The center pinch rollers 72 are provided in a printing area of the inkjet head 20 in the scanning direction Y. However, the center pinch rollers 72 are provided on the second transportation direction X2 side with respect to the inkjet head 20, and therefore, do not contact the image during the printing.

In the first working mode, when the printing is finished, the recording medium 5 needs to be moved in the second transportation direction X2 in order to be cut. If the recording medium 5 is moved in the second transportation direction X2 while being held between the center pinch rollers 72 and the grit rollers 57, the center pinch rollers 72 move on the printed image, which may undesirably influence the quality of the image. Therefore, when the printing is finished, the controller 50 drives the motor 92 to rotate the second holding shaft 90 in the direction of arrow H1 in FIG. 13. Thus, each of the eccentric cams 88 also rotates in the direction of arrow H1, and pushes up the stopping member 79 of the second holding member 74. As a result, as shown in FIG. 14, the center pinch rollers 72 move upward, and thus are separated from the grit rollers 57. Even if the second holding shaft 90 rotates, the side pinch rollers 62 do not move upward. Therefore, the recording medium 5 is kept held between the side pinch rollers 62 and the grit rollers 57. After the above-described movement of the center pinch rollers 72, the grit rollers 57 are driven to transport the recording medium 5 back in the second transportation direction X2, and the cutting of the recording medium 5 is started.

The cutting is performed while the recording medium 5 is transported in the first transportation direction X1 and the second transportation direction X2. Before the cutting, the inkjet head 20 and the cutting head 30 are separated from each other. During the cutting, the printer 100 controls the carriage motor 44 to run the cutting head 30 in the scanning direction Y while moving the recording medium 5 in the first transportation direction X1 and the second transportation direction X2. As a result, the cutter 33 moves two-dimensionally with respect to the recording medium 5, and thus the recording medium 5 is cut along cutting lines of the cutting data.

During the cutting, a portion of the printed image may pass on the plurality of grit rollers 57 arrayed in a line. However, in the first working mode, the center pinch rollers 72 are located at the separation positions during the cutting. Therefore, the center pinch rollers 72 do not contact the printed image. During the cutting, the recording medium 5 is pressed from above only by the side pinch rollers 62. The side pinch rollers 62 are provided outer to the printing area in the scanning direction Y. Therefore, the side pinch rollers 62 do not contact the printed image, either.

When the cutting of the recording medium 5 is finished, the operator pushes up the loading lever 82 in the direction of arrow U2 in FIG. 10. Thus, the first holding shaft 80 rotates in the direction of arrow R2 in FIG. 10. As a result, the side pinch rollers 62 are separated from the grit rollers 57, and thus the recording medium 5 is removable from the platen 16. After the cutting is finished, the controller 50 drives the motor 92 to rotate the second holding shaft 90 in the direction of arrow H2 in FIG. 14. As a result, each of the eccentric cams 88 also rotates in the direction of arrow H2, and is separated from the stopping member 79. Thus, the center pinch rollers 72 are moved downward.

(Second Working Mode)

In the case where the second working mode is set, the cutting is first performed, and then, the printing is performed. The second working mode has advantages that, for example, it is not needed to wait for the printed image to be dried, or that the expansion and the contraction of the recording medium 5 caused as a result of the recording medium 5 absorbing the ink does not influence the cutting. Therefore, there are cases where the printing and the cutting in the second working mode are desired.

The cutting operation in the second working mode is performed in generally the same manner as in the first working mode. It should be noted, however, that in the second working mode, the center pinch rollers 72 are located at the holding positions during the cutting. In the second working mode, during the cutting, the center pinch rollers 72 hold the recording medium 5 together with the grit rollers 57 facing the center pinch rollers 72. In the second working mode, no image has not been printed on the recording medium 5 when the recording medium 5 is cut. Therefore, it is not needed to move the center pinch rollers 72 to the separation positions to avoid contact of the center pinch rollers 72 with the printed image.

In the second working mode, the printing is performed after the cutting. Before the printing, the recording medium 5 is transported back in the second transportation direction X2. The printing in the second working mode is performed in the same manner as in the first working mode. Namely, during the printing, the recording medium 5 is intermittently transported in the first transportation direction X1, and during this period, the center pinch rollers 72 are located at the holding positions. The printing is performed in the state in which the center pinch rollers 72 and the side pinch rollers 62 hold the recording medium 5 together with the grit rollers 57. The work of removing the recording medium 5 from the printer 100 after the printing is substantially the same as in the first working mode.

As described above, with the printer 100 according to this preferred embodiment, in the first working mode, in which the printing is performed before the cutting, during the cutting, the center pinch rollers 72 are retracted to the separation positions, at which the center pinch rollers 72 are separated from the recording medium 5, and thus do not contact the printed image. Therefore, an inconvenience that the printed image is damaged or the like is avoided. During the cutting, only the pair of side pinch rollers 62, which are respectively provided at the two ends, namely, at the left and right ends, of the platen 16 and do not contact the printing area, press the recording medium 5. By contrast, in the second working mode, in which the cutting is performed before the printing, during the cutting, the center pinch rollers 72 are located at the holding positions, at which the center pinch rollers 72 contact the recording medium 5, and thus press the recording medium 5 together with the side pinch rollers 62. This stabilizes the movement of the recording medium 5 in the transportation direction X.

As described above, according to this preferred embodiment, the center pinch rollers 72 are left at the holding positions during the cutting in the case where the cutting is performed first. This stabilizes the movement of the recording medium 5 during the cutting. Therefore, in the case where the cutting is performed before the printing, the cutting quality is improved.

According to this preferred embodiment, the printing and the cutting are performed in the order of being written in the working data. With such a structure, the order of the printing and the cutting is automatically set, and thus the operator does not need to operate the printer 100.

The transportation device 55 according to this preferred embodiment has, for example, the following advantages as a mechanical device.

With the printer 100 according to this preferred embodiment, the rotator 81 rotates the first holding shaft 80 to cause the side pinch rollers 62 and the center pinch rollers 72 to approach the grit rollers 57. With such a structure, the recording medium 5 is held between the side pinch rollers 62 and the grit rollers 57 and between the center pinch rollers 72 and the grit rollers 57. This stabilizes the transportation of the recording medium 5 in the transportation direction X during the printing. In addition, the motor 92 rotates the second holding shaft 90 to put the eccentric cams 88 into contact with the second holding members 74. With such a structure, the center pinch rollers 72 are moved upward. As a result, a state is realized in which the side pinch rollers 62 and the grit rollers 57 hold the recording medium 5 whereas the center pinch rollers 72 and the grit rollers 57 do not hold the recording medium 5. Therefore, in the first working mode, when the recording medium 5 is to be cut after being transported in the second transportation direction X2, the center pinch rollers 72 are prevented from contacting the printed image while the recording medium 5 is moved by the side pinch rollers 62.

With the printer 100 according to this preferred embodiment, the distance between the rotation center 89C and the outer circumferential surface 89K of each of the eccentric cams 88 is not constant in the entirety of the circumference of the eccentric cam 88. This easily allows the eccentric cam 88 and the second holding member 74 to contact each other and to be separated from each other.

With the printer 100 according to this preferred embodiment, the eccentric cams 88 each include the first portion 89X and the second portion 89Y. In the first portion 89X, the distance between the rotation center 89C and the outer circumferential surface 89K gradually increases. In the second portion 89Y, the distance between the rotation center 89C and the outer circumferential surface 89K is longer than in the first portion 89X and is constant. The eccentric cam 88 contacts the second holding member 74 in the first portion 89X and then contacts the second holding member 74 in the second portion 89Y. This allows the second holding member 74 to contact the eccentric cam 88 smoothly, and also prevents generation of strange noise and application of an excessive load on the second holding member 74.

With the printer 100 according to this preferred embodiment, the first member 89A and the second holding shaft 90 are made of a metal material, and therefore, are secured strongly to each other. The second member 89B in contact with the second holding member 74 is made of a resin material, and therefore, is highly durable.

With the printer 100 according to this preferred embodiment, the eccentric cams 88 each push up the corresponding stopping member 79 to move the center pinch roller 72 upward. With such a simple structure in which the eccentric cam 88 contacts and pushes up the stopping member 79, the center pinch roller 72 is moved upward.

With the printer 100 according to this preferred embodiment, the left end 79L of the stopping member 79 is located to the right of the left end 72L of the center pinch roller 72 as seen in a front view. The right end 79R of the stopping member 79 is located to the left of the right end 72R of the center pinch roller 72 as seen in a front view. With such a structure, the center pinch roller 72 is lifted up with a relatively small force.

With the printer 100 according to this preferred embodiment, the center 79C of the stopping member 79 in the scanning direction Y and the center 72C of the center pinch roller 72 in the scanning direction Y match each other. With such a structure, the center pinch roller 72 is lifted up with a relatively small force.

With the printer 100 according to this preferred embodiment, the first support members 93 support the second holding shaft 90 and are each attached to a portion of the frame member 18 that is to the left of the corresponding eccentric cam 88. The second support members 94 support the second holding shaft 90 and are each attached to a portion of the frame member 18 that is to the right of the corresponding eccentric cam 88. With such a structure, the second holding shaft 90 is prevented from sagging due to the reaction force of the second holding members 74 applied to the second holding shaft 90 via the eccentric cams 88. Namely, the center pinch rollers 72 are moved upward more certainly.

With the printer 100 according to this preferred embodiment, the frame member 18 includes the inclining wall 18L. When the grit rollers 57 are not located below the center pinch rollers 72 and the first holding shaft 80 rotates, the inclining wall 18L contacts the second holding members 74 to inhibit the center pinch rollers 72 from moving downward. In this manner, in the case where the grit rollers 57 are not located below the center pinch rollers 72, the frame member 18 prevents the center pinch rollers 72 from contacting the recording medium 5.

(Modifications)

The above-described embodiment may be carried out in any of other preferred modifications. For example, in one preferred modification, the working mode is selected by the operator. This preferred modification is the same as the above-described embodiment except for this. Thus, in the following description of the preferred modification, the identical components to those in the above-described embodiment will bear the identical reference signs, and overlapping descriptions will be omitted or simplified.

Figure 16:
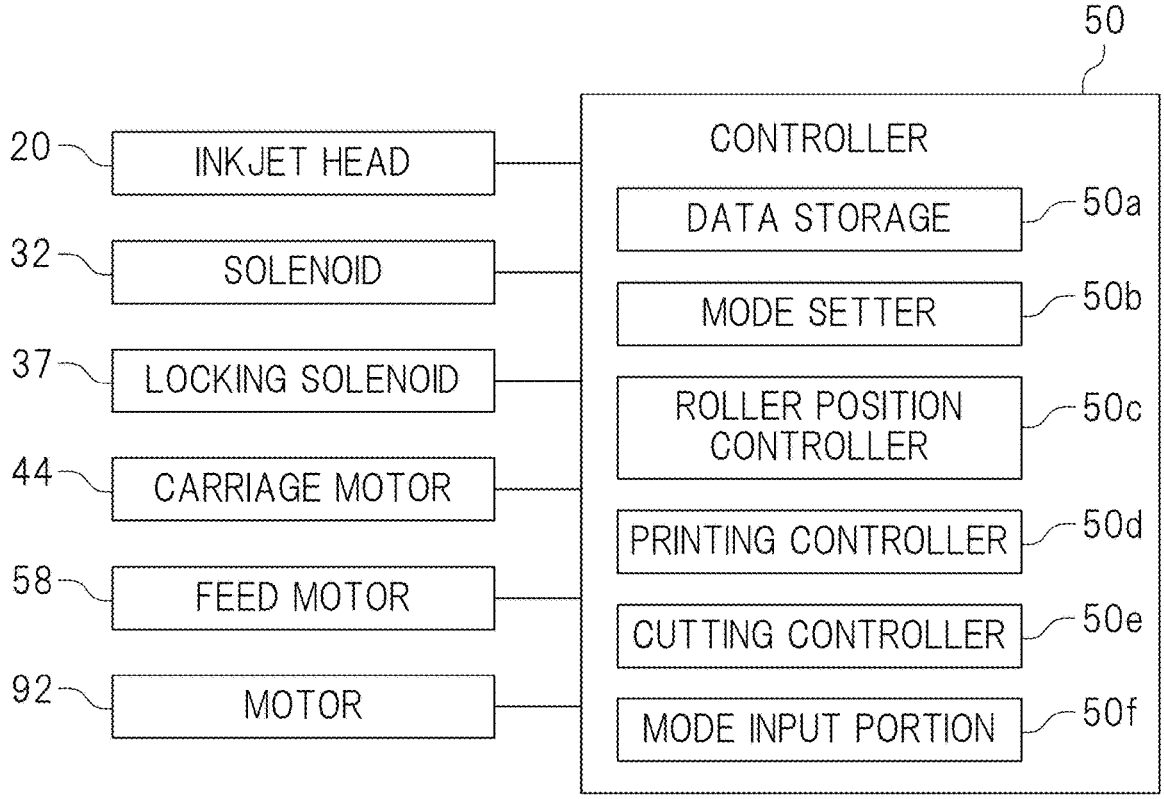
FIG. 16 is a block diagram of a control system of a cutting head-including printer according to a modification of a preferred embodiment of the present invention.

FIG. 16 is a block diagram of a control system of the printer 100 according to this preferred modification. As shown in FIG. 16, in this preferred modification, the controller 50 includes a mode input portion 50*f*. The mode input portion 50*f* allows one of the first working mode and the second working mode to be input thereto. The mode input portion 50*f* causes, for example, the operation panel 12 or the like to display a screen on which the working mode may be selected. In this preferred modification, the mode setter 50*b* sets the working mode to the working mode input to the mode input portion 50*f*.

The mode input portion 50*f* and the mode setter 50*b* operating as described above allow the printing and the cutting to be performed in an order different from the order assumed when the working data is created. Therefore, in the case where it is wished to perform the printing and the cutting in an order different from the order assumed when the working data is created, it is not needed to correct the working data. For example, the mode setter 50*b* may basically set the working mode such that the printing and the cutting are performed in the order written in the working data and change the working mode only when the working mode is changed by the mode input portion 50*f*.

Some preferred embodiments of the present invention are described above. The above-described embodiments and the modifications are merely examples, and the present invention may be carried out in any of various other embodiments or modifications.

For example, in the above-described embodiment, the side pinch rollers 62 and the center pinch rollers 72 are put into contact with the recording medium 5 at the same time by the operator operating the loading lever 82. Only the center pinch rollers 72 are moved upward to be separated from the recording medium 5 when necessary. The mechanism that moves the side pinch rollers 62 and the center pinch rollers 72 is not limited to this. The side pinch rollers 62 and the center pinch rollers 72 may be moved independently by separate moving mechanisms. The mechanism that moves the side pinch rollers 62 and the center pinch rollers 72 does not need to be a mechanism that rotates the side pinch rollers 62 and the center pinch rollers 72 about a rotation shaft extending in the scanning direction Y. For example, the side pinch rollers 62 and the center pinch rollers 72 may be simply moved in the up-down direction. There is no specific limitation on the mechanism that moves the side pinch rollers 62 and the center pinch rollers 72.

The embodiments described herein do not limit the present invention unless otherwise specified.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A cutting head-including printer, comprising:

a supporting table including a carrying surface on which a recording medium is to be placed;

a transportation mechanism that transports the recording medium placed on the carrying surface in a first transportation direction and a second transportation direction opposite to the first transportation direction;

a printing head provided to face the carrying surface;

a cutting head provided to face the carrying surface; and a controller, wherein:

the transportation mechanism includes:

a pair of side pinch rollers provided to face both of two ends of the carrying surface in a direction perpendicular to the first transportation direction, a center pinch roller provided between the pair of side pinch rollers and facing the carrying surface, at least one driving roller that is provided on the supporting table to face the pair of side pinch rollers and the center pinch roller and has at least a portion thereof exposed to the carrying surface, a driving mechanism that rotates the at least one driving roller in the first transportation direction and the second transportation direction, and a roller moving mechanism that causes the center pinch roller to approach or, to be separated from, the at least one driving roller, the side pinch rollers hold the recording medium placed on the carrying surface together with the at least one driving roller, the roller moving mechanism moves the center pinch roller to a first position at which the center pinch roller holds the recording medium placed on the carrying surface together with the at least one driving roller and to a second position at which the center pinch roller is separated from the at least one driving roller, and the controller includes:

a data storage that stores working data including at least one of printing data and cutting data, a mode setter that sets a working mode in which printing and cutting are executed to a first working mode or to a second working mode, the first working mode being a working mode in which the printing is first executed and then the cutting is executed, and the second working mode being a working mode in which the cutting is first executed and then the printing is executed, and a roller position controller that controls the roller moving mechanism to, in the case where the working mode is set to the first working mode, locate the center pinch roller at the second position during the cutting and to, in the case where the working mode is set to the second working mode, locate the center pinch roller at the first position during the cutting.

2. The cutting head-including printer according to claim 1, wherein in the case where the printing data is written before the cutting data in the working data, the mode setter sets the working mode to the first working mode, and in the case where the cutting data is written before the printing data in the working data, the mode setter sets the working mode to the second working mode.

3. The cutting head-including printer according to claim 1, wherein:

the controller further includes a mode input portion that allows one of the first working mode and the second working mode to be input thereto, and the mode setter sets the working mode to the working mode input to the mode input portion.

* * * * *